US008487966B2

(12) United States Patent
Nose

(10) Patent No.: US 8,487,966 B2
(45) Date of Patent: Jul. 16, 2013

(54) SUPPORT METHOD

(75) Inventor: Masaki Nose, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 866 days.

(21) Appl. No.: 12/626,142

(22) Filed: Nov. 25, 2009

(65) Prior Publication Data

US 2010/0134537 A1 Jun. 3, 2010

(30) Foreign Application Priority Data

Nov. 28, 2008 (JP) ..... 2008-305296

(51) Int. Cl.
*G09G 5/10* (2006.01)

(52) U.S. Cl.
USPC ..... 345/690; 345/87

(58) Field of Classification Search
None
See application file for complete search history.

(56) References Cited

U.S. PATENT DOCUMENTS

| | | | | |
|---|---|---|---|---|
| 3,995,942 | A * | 12/1976 | Kawakami et al. | 345/94 |
| 5,526,013 | A * | 6/1996 | Ono et al. | 345/94 |
| 6,278,429 | B1 * | 8/2001 | Ruth et al. | 345/94 |
| 6,313,896 | B1 * | 11/2001 | Samant et al. | 349/124 |
| 6,492,970 | B1 * | 12/2002 | Furuhashi et al. | 345/94 |
| 6,801,182 | B2 * | 10/2004 | Yang et al. | 345/100 |
| 6,812,913 | B2 | 11/2004 | Masazumi | |
| 7,245,282 | B2 * | 7/2007 | Jones | 345/94 |
| 2001/0048498 | A1 * | 12/2001 | Tomioka et al. | 349/123 |
| 2002/0050970 | A1 * | 5/2002 | Kajihara et al. | 345/89 |
| 2002/0145602 | A1 * | 10/2002 | Matsueda | 345/213 |
| 2003/0156089 | A1 * | 8/2003 | Yamakawa et al. | 345/96 |
| 2004/0239609 | A1 * | 12/2004 | Lee et al. | 345/100 |
| 2004/0246221 | A1 * | 12/2004 | Izumi | 345/94 |
| 2006/0221031 | A1 * | 10/2006 | Chang et al. | 345/89 |
| 2007/0279404 | A1 * | 12/2007 | Kinjo et al. | 345/205 |

(Continued)

FOREIGN PATENT DOCUMENTS

| | | | |
|---|---|---|---|
| JP | 2001-228459 | A1 | 8/2001 |
| JP | 2008-268566 | | 11/2008 |

(Continued)

OTHER PUBLICATIONS

Y.-M. Zhu, et al.; "P-82: Cumulative Drive Schemes for Bistable Reflective Cholesteric LCDs;" SID 98 Digest; 1998; pp. 798-801 (4 Sheets.).

*Primary Examiner* — Peter Vincent Agustin
(74) *Attorney, Agent, or Firm* — Kratz, Quintos & Hanson, LLP

(57) ABSTRACT

The display apparatus includes a dot matrix type display device including a display material; a driver circuit that passively drives a plurality of pixels in the display device; and a control circuit that controls the driver circuit. The control circuit applies a voltage pulse to initialize a plurality of pixels to be rewritten and applies a voltage pulse to change a tone state of the plurality of pixels and display the tone. The voltage pulse to be applied for the tone display includes an all-selected voltage pulse to be applied to a plurality of pixels the tone state of which are changed, and a half-selected voltage pulse and a non-selected voltage pulse to be applied to a plurality of pixels the tone state of which are not changed, and a ratio of the all-selected voltage to the half-selected voltage is larger than $2^{1/2}$ and smaller than 2.

4 Claims, 26 Drawing Sheets

U.S. PATENT DOCUMENTS

| | | | | |
|---|---|---|---|---|
| 2008/0259015 | A1 | 10/2008 | Nose | |
| 2008/0284712 | A1 * | 11/2008 | Muto et al. | 345/101 |
| 2009/0147211 | A1 | 6/2009 | Niiyama et al. | |
| 2009/0174641 | A1 | 7/2009 | Nose | |
| 2010/0020055 | A1 | 1/2010 | Nose et al. | |
| 2010/0134537 | A1 * | 6/2010 | Nose | 345/690 |

FOREIGN PATENT DOCUMENTS

| | | | |
|---|---|---|---|
| JP | 2009-163092 | A1 | 7/2009 |
| WO | WO 2007/070093 | A2 | 6/2007 |
| WO | 2008/007715 | | 1/2008 |
| WO | 2008/139504 | | 11/2008 |

* cited by examiner

| COMMON | SEGMENT | POSITIVE | NEGATIVE |
|---|---|---|---|
| ON | ON | 20 | −20 |
| | OFF | 10 | −10 |
| OFF | ON | 5 | −5 |
| | OFF | −5 | 5 |

FIG.12

| | ALL-SELECTED | HALF-SELECTED |
|---|---|---|
| V | 20 | 10 |
| T | 5 | 5 |
| $V^2T$ | 2000 | 500 |

| | ALL-SELECTED | HALF-SELECTED |
|---|---|---|
| V | 25 | 15 |
| T | 3.2 | 3.2 |
| $V^2T$ | 2000 | 720 |

LOW FREQUENCY

MEDIUM FREQUENCY

HIGH-FREQUENCY

FIG.23A

| | ANTERIOR HALF | LATTER HALF |
|---|---|---|
| ON-SEG | 36 | 0 |
| | | |
| OFF-SEG | 36 | 0 |
| | | |
| ON-COM | 0 | 36 |
| | | |
| OFF-COM | 36 | 0 |

FIG.23B

| | ANTERIOR HALF | LATTER HALF |
|---|---|---|
| SELECTED ON | 36 | -36 |
| | | |
| SELECTED OFF | 36 | -36 |
| | | |
| NON-SELECTED ON | 0 | 0 |
| | | |
| NON-SELECTED OFF | 0 | 0 |

FIG.25A

| | ANTERIOR HALF | LATTER HALF |
|---|---|---|
| ON-SEG | 24 | 0 |
| | | |
| OFF-SEG | 14 | 10 |
| | | |
| ON-COM | 0 | 24 |
| | | |
| OFF-COM | 19 | 5 |

FIG.25B

| | ANTERIOR HALF | LATTER HALF |
|---|---|---|
| SELECTED ON | 24 | -24 |
| | | |
| SELECTED OFF | 14 | -14 |
| | | |
| NON-SELECTED ON | 5 | -5 |
| | | |
| NON-SELECTED OFF | -5 | 5 |

SUPPORT METHOD

CROSS-REFERENCE TO RELATED APPLICATIONS

This application is based upon and claims the benefit of priority of the prior Japanese Patent Application No. 2008-305296, filed on Nov. 28, 2008, the entire contents of which are incorporated herein by reference.

FIELD

The present disclosure relates generally to a display apparatus using a display material with a memory function.

BACKGROUND

Recently, the development of electronic paper has been advancing vigorously in business organizations and universities. Contemplated for the future electronic paper application markets are various potential application forms including electronic books heading the list, sub-displays for mobile terminals, display parts for IC cards, etc. One of the most promising modes for the electronic paper is one using a cholesteric liquid crystal. Cholesteric liquid crystals have excellent characteristics such as semi-permanent display maintaining function (memory function), bright color display, high contrast, and high resolution.

Cholesteric liquid crystals are sometimes called chiral nematic liquid crystals. A cholesteric liquid crystal is a liquid crystal in which molecules of nematic liquid crystal form a helical cholesteric phase by adding a comparatively large amount (several tens of percent) of chiral additive (chiral agent). A cholesteric liquid crystal display apparatus performs a display process using orientation states of the liquid crystal molecules.

For the multi-tone display method by cholesteric liquid crystal, various driving methods have been proposed. The driving methods for the multi-tone display by cholesteric liquid crystal are divided into two methods of dynamic driving and conventional driving.

The dynamic driving method requires a complicated control circuit and a driver IC because a driving waveform of the dynamic driving method is complicated. Moreover, a low resistance electrode is required as the transparent electrode of the panel, and this increases the manufacturing cost. Furthermore, the dynamic driving method requires high power consumption. Recently, a dynamic driving method that employs an inexpensive general-purpose driver has been tried. However, there are drawbacks such as the inability to obtain a high contrast display, and there is a trade-off between cost reduction and display quality.

A conventional driving method drives liquid crystal at a comparatively high speed of quasi-video rate so as to gradually change from the planar state to the focal conic state or from the focal conic state to the planar state by using the cumulative time particular to the liquid crystal and adjusting the number of times of application of a short pulse.

When tones are set by using the cumulative time by the conventional driving method, methods are available in which the number of times of application of a short pulse is adjusted and in which the pulse width W is varied. The method in which the pulse width is varied is more advantageous in power consumption suppression than the method in which the number of times of application of a short pulse is adjusted. A method is also available in which the cumulative time of pulse application is varied for both the pulse width and the number of times of pulse application.

Generally, the conventional driving method, compared with dynamic driving method, is more advantageous in that the conventional driving method provides lower power consumption at writing, cost reduction of circuit parts, and more stable high contrast display.

Although the conventional driving method is advantageous in cost and display quality, the method has a drawback in that the writing speed is slower than that of the dynamic driving method. For example, in a display apparatus with a standard panel structure that includes many lines such as XGA specification (1024×768 pixels), for multi-color display of 4096 colors (4 bits for each color, 16 tones), the writing time for one line is approximately 13 ms to 15 ms and the writing time for all lines is approximately 10 to 12 seconds.

In order to achieve faster processing speed, reducing viscosity of liquid crystal is generally known. However, this is not easy to achieve, because there is a trade-off between such reduction of viscosity and electrical and optical properties which are important properties of liquid crystal. Thus, achieving such speed-up by methods other than the method to reduce viscosity of liquid crystal is sought after.

SUMMARY

It is an aspect of the embodiments disclosed herein to provide a display apparatus. The display apparatus may include a dot matrix type display device including a display material with a memory function; a driver circuit that passively drives a plurality of pixels in the display device; and a control circuit that controls the driver circuit, wherein the control circuit applies a voltage pulse to initialize a plurality of pixels to be rewritten and applies a voltage pulse to change a tone state of the plurality of pixels and display the tone, and the voltage pulse to be applied for the tone display includes an all-selected voltage pulse to be applied to a plurality of pixels the tone state of which are changed, and a half-selected voltage pulse and a non-selected voltage pulse to be applied to a plurality of pixels the tone state of which are not changed, and a ratio of the all-selected voltage to the half-selected voltage is larger than $2^{1/2}$ and smaller than 2.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 12 illustrates exemplary charts for explaining a relationship when changing an all-selected voltage and a half-selected voltage;

FIG. 13A represents the response characteristics in terms of a brightness Y, and FIG. 13B represents the same response characteristics in terms of a brightness indicator L* in a uniform color space;

FIG. 19A depicts response characteristics when low-frequency pulse is applied while FIG. 19B depicts response characteristics when a high-frequency pulse is applied;

FIGS. 23A and 23B illustrate charts depicting output voltages of drivers and voltages applied to pixels at the reset processing of an exemplary embodiment;

FIGS. 25A and 25B illustrate output voltages of drivers and voltages applied at the writing processing in an exemplary embodiment.

DESCRIPTION OF EMBODIMENTS

Figure 1A:
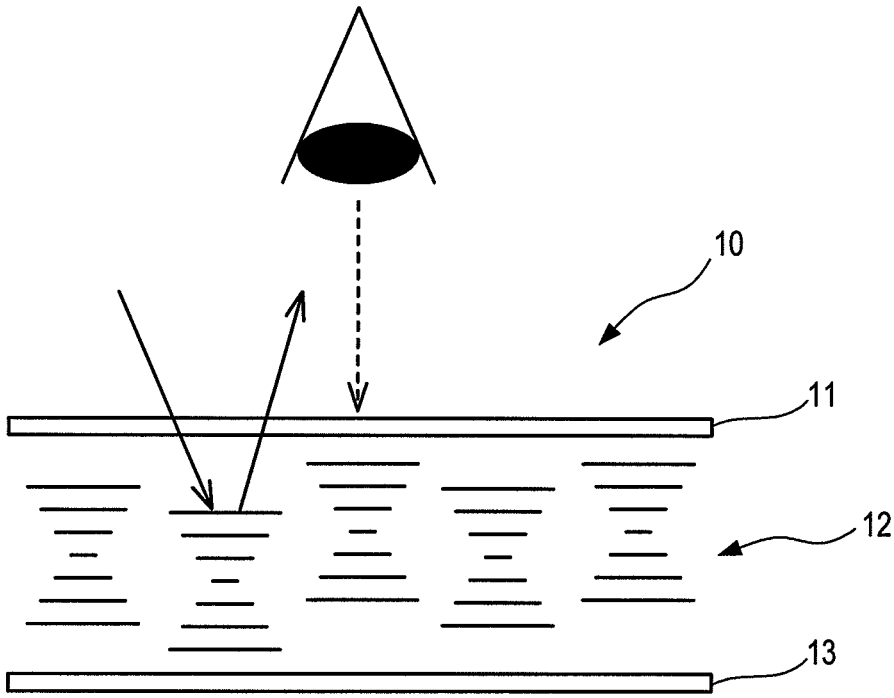
FIGS. 1A and 1B illustrate schematic views of a display device for explaining bistable states (planar state and focal-conic states) of a cholesteric liquid crystal.
Figure 1B:
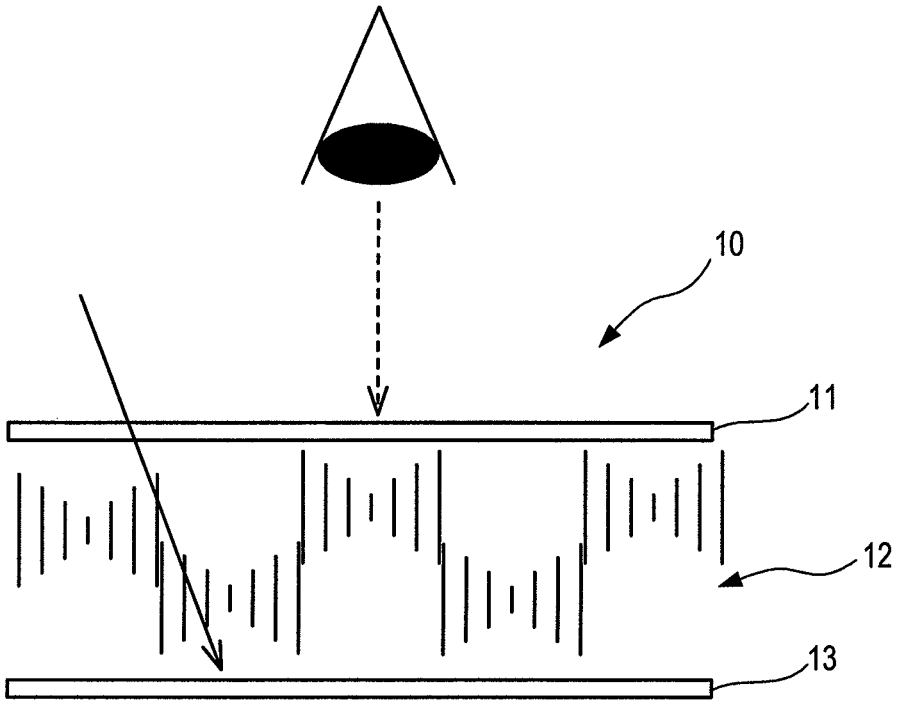

FIG. 1 illustrates states of a cholesteric liquid crystal. As depicted in FIGS. 1A and 1B, a display device 10 that employs cholesteric liquid crystal includes an upper substrate 11, a cholesteric liquid crystal layer 12, and a lower substrate 13. The cholesteric liquid crystal has a planar state and a focal conic state. In the planar state, incident light is reflected as illustrated in FIG. 1A, while in the focal conic state, incident light is transmitted as illustrated in FIG. 1B. The planar state and the focal conic state are stably held even under a non-electrolytic condition.

In the planar state, cholesteric liquid crystal reflects light of a wavelength corresponding to the helical pitch of the liquid crystal molecules. The wavelength λ where the reflection is the highest is expressed by the following expression from the average refractive index n and helical pitch p of the liquid crystal:

$$\lambda = np$$

On the other hand, reflection band Δλ largely differs according to the refractive index anisotropy Δn of the liquid crystal.

In the planar state, since the incident light is reflected, a "bright" state is produced; that is, white may be displayed. On the other hand, in the focal conic state, by providing a light absorbing layer under the lower substrate 13, the light transmitted through the liquid crystal layer is absorbed, so that "dark" state is produced; that is, black may be displayed.

Now, a method to drive display device using cholesteric liquid crystal will be described.

Figure 2:
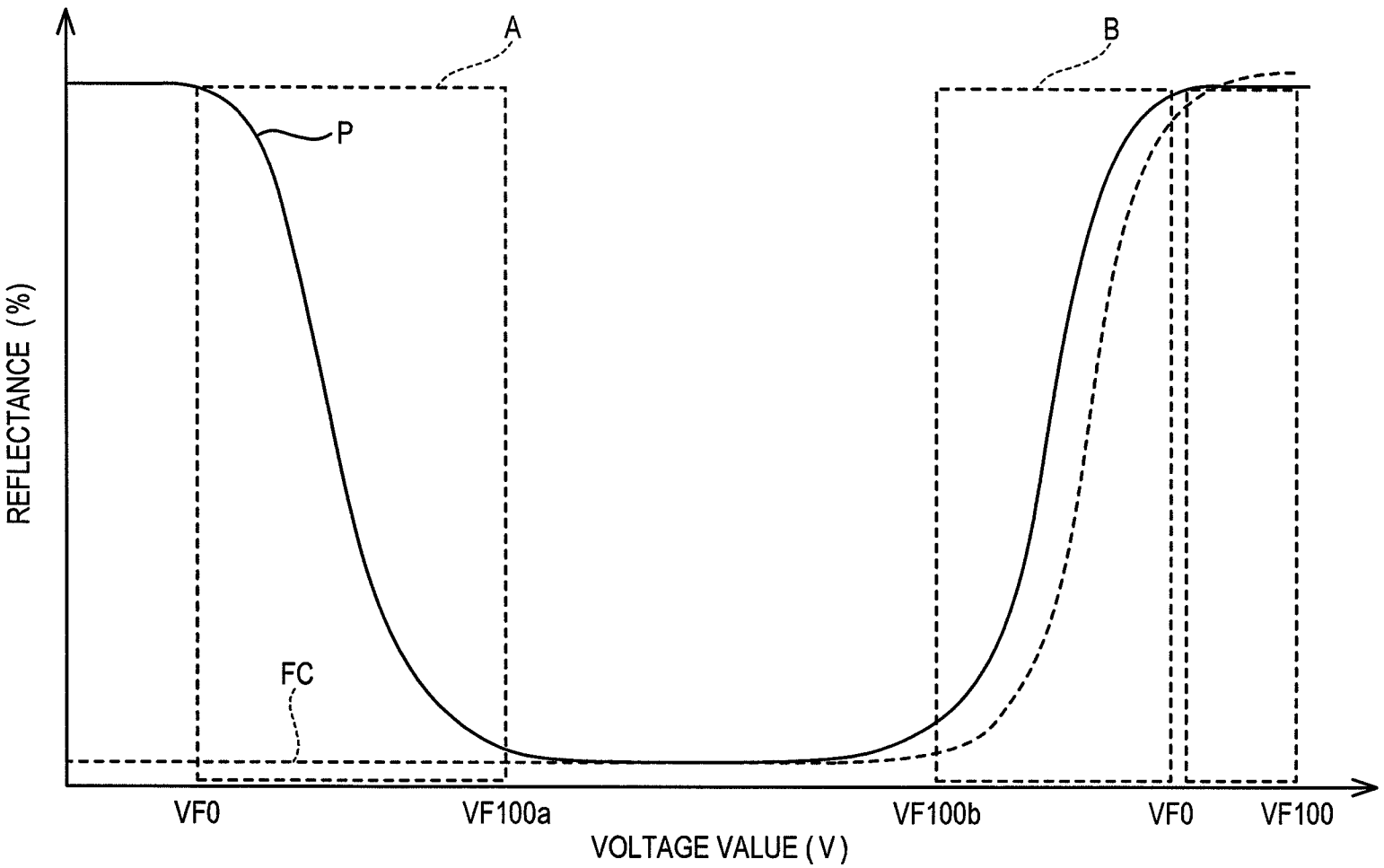
FIG. 2 illustrates an exemplary graph for explaining the state change of a cholesteric liquid crystal by a pulse voltage.

FIG. 2 illustrates a voltage-reflection characteristic of a typical cholesteric liquid crystal. The horizontal axis represents the voltage value (V) of a pulse voltage applied, with a given pulse width, between the electrodes sandwiching the cholesteric liquid crystal. The vertical axis represents the reflectance (%) of the cholesteric liquid crystal. The solid curved line P represents the voltage-reflectance characteristic of cholesteric liquid crystal, the initial state of which is the planar state. The broken curved line FC represents the voltage-reflectance characteristic of cholesteric liquid crystal, the initial state of which is the focal conic state.

In FIG. 2, when a relatively strong electric field is applied to the cholesteric liquid crystal by applying a given high voltage VP100 (for example, ±36 V) between the electrodes, the helical structure of the liquid crystal molecules is completely disentangled, so that the liquid crystal is brought into a homeotropic state where all the molecules follow the direction of the electric field. Then, when the electric field in the liquid crystal is rapidly reduced to substantially zero by rapidly reducing the applied voltage from VP100 to a given low voltage (for example, VF0=±4 V), and the liquid crystal molecules are in the homeotropic state, the helical axis of the liquid crystal is vertical to the electrodes, so that the liquid crystal is brought into the planar state where light corresponding to the helical pitch is selectively reflected.

On the other hand, when a relatively weak electric field is applied to the cholesteric liquid crystal by applying a given low voltage VF 100*b* (for example, ±24 V) between the electrodes, the liquid crystal is brought into a state where the helical structure of the liquid crystal molecules is not completely disentangled. Under this state, when the electric field in the liquid crystal is rapidly reduced to substantially zero by rapidly reducing the applied voltage from VF 100*b* to the low voltage VF0, or the electric field is slowly removed by applying a strong electric field, the helical axis of the liquid crystal molecules becomes parallel to the electrodes, so that the liquid crystal is brought into the focal conic state where incident light is transmitted.

When the electric field is rapidly removed by applying an electric field of intermediate strength, the planar state and the focal conic state coexist, so that intermediate tones may be displayed.

Here, as illustrated by the curved line P in the broken line frame A depicted in FIG. 2, the reflectance of the cholesteric liquid crystal may be reduced by increasing the ratio of the focal conic state as the voltage value of the applied voltage pulse is increased. As illustrated by the curved lines P and FC in the broken line frame B depicted in FIG. 2, the reflectance of the cholesteric liquid crystal may be reduced by increasing the ratio of the focal conic state as the applied voltage value is reduced.

To display intermediate tones, the area A or the area B is used. When the area A is used, after the pixels are initialized to the planar state, a voltage pulse between VF0 and VF100*a* is applied so that the liquid crystal is partly in the focal conic state. When the area B is used, after the pixels are initialized to the focal conic state, a voltage pulse between VF100*b* and VP0 is applied so that the liquid crystal is partly in the planar state.

Figure 3A:
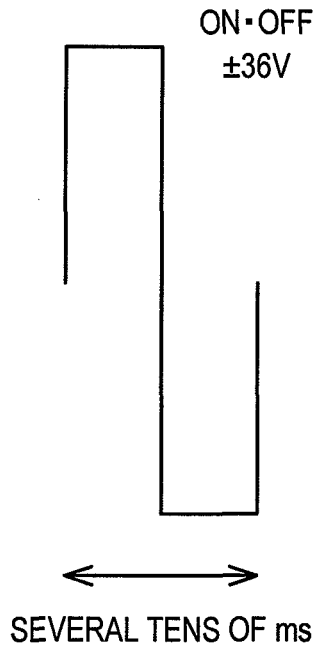
FIGS. 3A and 3B illustrate an exemplary waveform of a voltage pulse and an exemplary diagram for explaining the reflectance change when a pulse of a specified voltage and a specified wide pulse width is applied to a cholesteric liquid crystal.
Figure 3B:
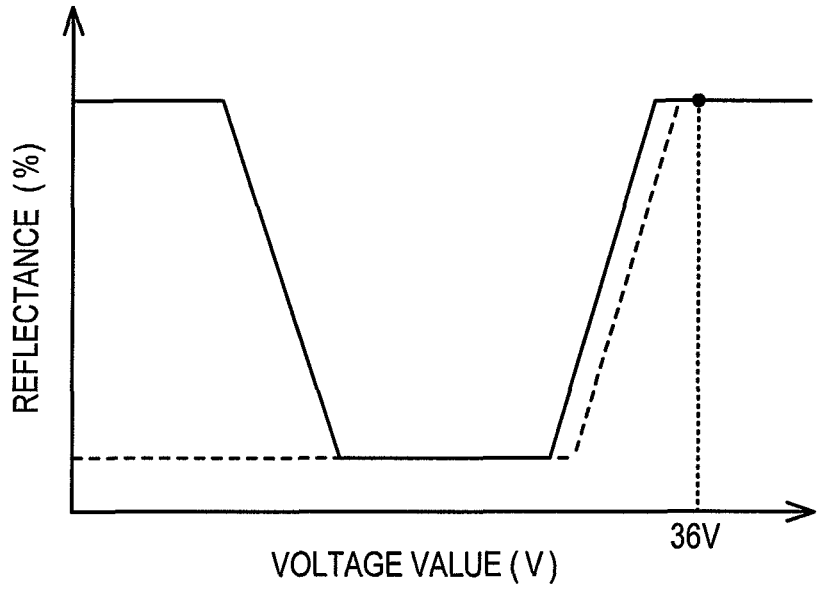
Figure 4A:
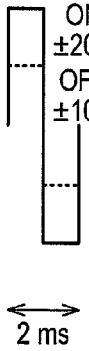
FIGS. 4A to 4D illustrate exemplary waveforms and diagrams for explaining the reflectance change by pulses of an intermediate voltage and two kinds of narrow pulse widths applied to a cholesteric liquid crystal.
Figure 4B:
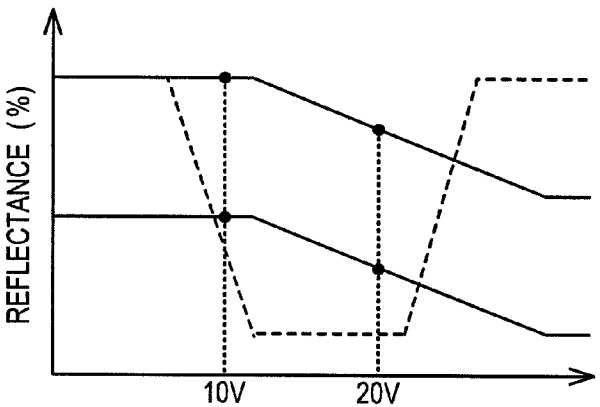
Figure 4C:
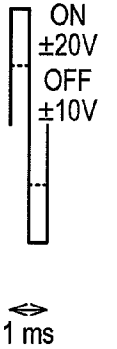
Figure 4D:
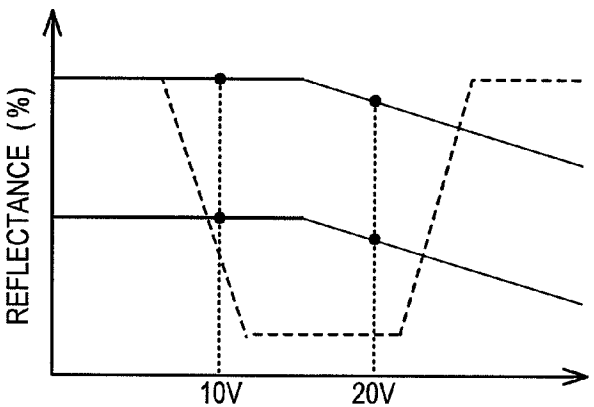

The principle of the driving method based on the above-described voltage response characteristic will be described. FIGS. 3A, 4A, and 4C illustrate exemplary waveforms of voltage pulses. FIGS. 3B, 4B, and 4D illustrate exemplary pulse response characteristics when the voltage pulses of FIGS. 3A, 4A, and 4C are applied, respectively. FIG. 3A illustrates an exemplary voltage pulse, the voltage value of which is ±36 V and the pulse width of which is several tens of ms. FIG. 4A illustrates an exemplary voltage pulse, the voltage value of which is ±20 V at the time of ON and is ±10 V at the time of OFF, and the pulse width of which is 2 ms. FIG. 4C illustrates an exemplary voltage pulse, the voltage value of which is ±20 V at the time of ON and is ±10 V at the time of OFF, and the pulse width of which is 1 ms. In FIGS. 3B, 4B, and 4D, the horizontal axis represents the voltage (V), and the vertical axis represents the reflectance (%). As the voltage-reflectance characteristic of FIG. 3B, the curved lines P and FC of FIG. 2 are schematically depicted, and as the voltage-reflectance characteristic of FIGS. 4B and 4D, only the curved line P of FIG. 2 is schematically depicted. The voltage pulses used in this embodiment are a combination of positive and negative pulses to prevent degradation of liquid crystal, for example, due to ion polarization.

As illustrated in FIGS. 3A and 3B, when the pulse width is large and the initial state is the planar state, the liquid crystal is brought into the focal conic state when the voltage is increased to a certain range. When the voltage is further increased, the liquid crystal is brought into the planar state again. If the initial state is the focal conic state, the liquid crystal is gradually brought into the planar state as the pulse voltage is increased.

When the pulse width is large, the pulse voltage that always brings the liquid crystal into the planar state irrespective of whether the initial state is the planar state or the focal conic state is ±36 V in the embodiment depicted in FIG. 3B. Moreover, with this intermediate pulse voltage, the planar state and the focal conic state coexist, so that intermediate tones are obtained.

On the other hand, as illustrated in FIGS. 4A and 4B, when the pulse width is 2 ms, if the initial state is the planar state, the reflectance does not change with a pulse voltage of ±10 V. However, if the voltage is higher than that, the planar state and the focal conic state coexist, so that the reflectance is decreased. Although the reflectance decrease amount increases as the voltage increases, when the voltage is higher than ±36 V, the reflectance decrease amount is constant. The same applies to a case where the planar state and the focal conic state coexist in the initial state. Therefore, when a voltage pulse with a pulse width of 2 ms and a pulse voltage of ±20 V is applied once in a case where the initial state is the planar state, the reflectance is decreased to some extent. When a voltage pulse with a pulse width of 2 ms and a pulse voltage of ±20 V is further applied in a state where the planar state and the focal conic state coexist (a state where the reflectance is slightly decreased) in this way, the reflectance is further decreased. By repeating this, the reflectance is decreased to a given value.

As illustrated in FIGS. 4C and 4D, when the pulse width is 1 ms, similarly to when the pulse width is 2 ms, the reflectance is decreased by applying a voltage pulse. However, the degree of reflectance decrease is lower than when the pulse width is 2 ms.

From the above, the following are considered: When a pulse of ±36 V with a pulse width of several tens of ms is applied, the liquid crystal is brought into the planar state. When a pulse of several tens of V to approximately ±20 V with a pulse width of approximately 2 ms is applied, the liquid crystal is brought from the planar state into a state where the planar state and the focal conic state coexist, and the reflectance is decreased. The reflectance decrease amount is related to the cumulative time of the pulse.

Therefore, in a cholesteric liquid crystal display apparatus, at a first step, an initialization pulse of ±36 V with a pulse width of several tens of ms is applied to the pixels to be rewritten, whereby the liquid crystal is brought into the planar state. At the next second step, a tone pulse of approximately ±20.0 V with a narrow pulse width is applied to the pixels to be made intermediate tones, and the cumulative application times thereof are made values corresponding to the levels of the intermediate tones. In other words, this display method uses the area A of FIG. 2 to display intermediate levels.

In the display apparatus, a plurality of scan electrodes parallel to each other are provided on one surface of a display material layer. A plurality of data electrodes parallel to each other and intersecting the plurality of scan electrodes are provided on the other surface of the display material layer, and pixels are formed at the intersections of the scan electrodes and the data electrodes. In this description, the scan electrodes are referred to as scan lines, and the data electrodes are referred to as data lines. In an embodiment of the display apparatus, a common driver may apply a scan pulse to the scan lines, and a segment driver may apply a data pulse to the data lines. Using general-purpose STN drivers for the common driver and the segment driver is desirable in terms of cost.

At the first step, pulses are simultaneously applied to all the scan lines and all the data lines. At the second step, since the tone level is set for each pixel, by applying the data pulse to all the data lines while applying the scan pulse to one scan line, the voltage pulse is applied to the pixels in one scan line. In this way, the scan line to which the scan pulse is applied is shifted in sequence to end the application of the voltage pulse to all the scan lines.

At the second step, while a selective scan voltage corresponding to the scan pulse is being applied to one scan line, a non-selective scan voltage is applied to the other scan lines. A selective data voltage corresponding to the data pulse is applied to the data lines of the pixels where tone writing is performed, and a non-selective data voltage is applied to the data lines of the pixels where no tone writing is performed. Consequently, the following pixels are present: pixels where the selective scan voltage and the selective data voltage are applied; pixels where the non-selective scan voltage and the selective data voltage are applied; pixels where the selective scan voltage and the non-selective data voltage are applied; and pixels where the non-selective scan voltage and the non-selective data voltage are applied. It is necessary to set the selective scan voltage, the non-selective scan voltage, the selective data voltage, and the non-selective data voltage so that the reflectance (tone) is decreased only at the pixels where the selective scan voltage and the selective data voltage are applied and the reflectance (tone) is not decreased at the other three kinds of pixels.

Figures 5A, 5B:
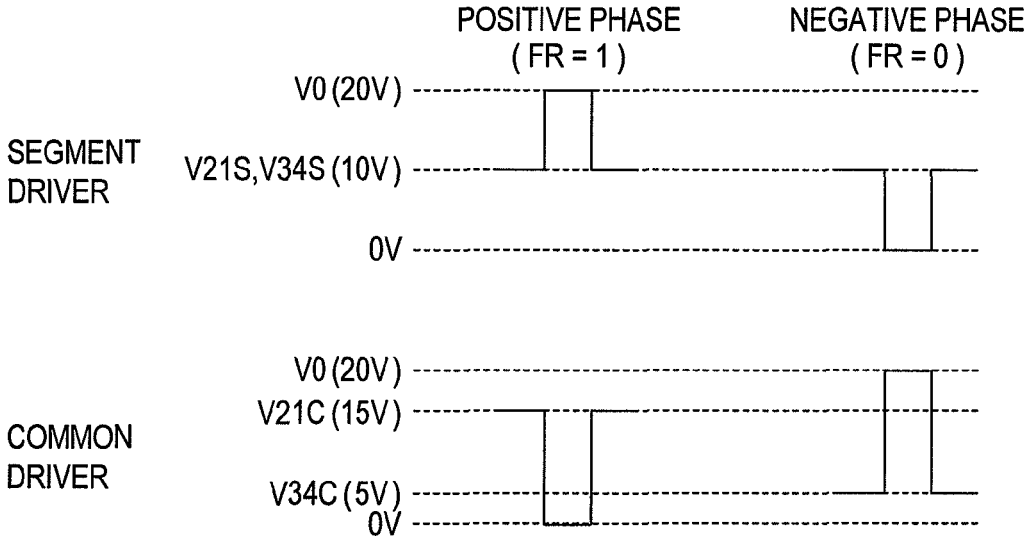
FIGS. 5A and 5B illustrate exemplary driver output voltages and liquid crystal application voltages when a tone pulse is applied.

In an embodiment of display apparatus using cholesteric liquid crystal, as the tone pulses change from the planar state to intermediate levels, the segment driver and the common driver output, for example, pulses as illustrated in FIG. 5A. By applying such pulses, voltages as illustrated in FIG. 5B are applied to the pixels.

To the segment driver, for example, 20 V is supplied as V0, and 10 V is supplied as V21S and V34S. In the positive phase (FR=1), a positive pulse is outputted. In the negative phase (FR=0), a negative pulse is outputted.

To the common driver, 20 V is supplied as V0, 15 V is supplied as V21C, and 5 V is supplied as V34C. In the positive phase (FR=1), a negative pulse is outputted. In the negative phase (FR=0), a positive pulse is outputted.

By the application of a pulse as illustrated in FIG. 5A, when the scan lines are in the selected state (common is ON) and the data lines are also in the selected state (segment is ON), 20 V is applied in the positive phase (FR=1) and −20 V is applied in the negative phase (FR=0). When the scan lines are in the selected state (common is ON) and the data lines are in the non-selected state (segment is OFF), 10 V is applied in the positive phase (FR=1) and −10 V is applied in the negative phase (FR=0). When the scan lines are in the non-selected state (common is OFF) and the data lines are in the selected state (segment is ON), 5 V is applied in the positive phase (FR=1), and −5 V is applied in the negative phase (FR=0). When the scan lines are in the non-selected state (common is OFF) and the data lines are in the non-selected state (segment is OFF), −5 V is applied in the positive phase (FR=1) and 5 V is applied in the negative phase (FR=0).

Figure 6A:
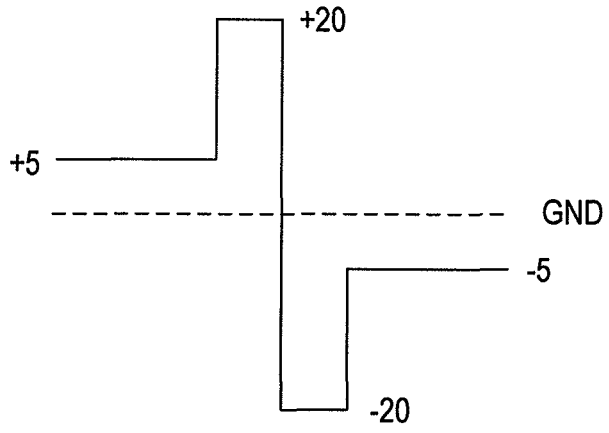
FIGS. 6A and 6B illustrate examples of symmetrical pulses applied to the liquid crystal.
Figure 6B:
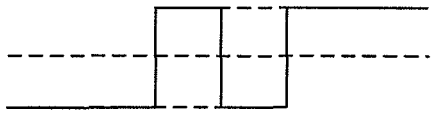

Therefore, the waveform of the voltage pulse applied to the pixels of the scan lines in the selected state is as illustrated in FIG. 6A, and the waveform of the voltage pulse applied to the pixels of the scan lines in the non-selected state is as illustrated in FIG. 6B. In both cases, the waveform of the data lines in the selected state is represented by a solid line, and the waveform of the data lines in the non-selected state is represented by a dotted line. As depicted in FIG. 4B, in the case of a voltage pulse with a pulse width of 2 ms, the state of the liquid crystal, that is, the reflectance is changed when the voltage is ±20 V, and the reflectance is not changed when the voltage is ±10 V. Therefore, if the waveform is as described above, writing by the tone pulse is performed when both the scan lines and the data lines are ON; otherwise, writing is not performed. Although there is a problem of crosstalk in actuality, this will not be described because it is not directly related to the present disclosure.

While the waveforms of the voltage pulses actually applied in the display apparatus are as illustrated in FIGS. 6A and 6B, the waveforms are sometimes expressed as positive and negative pulses symmetrical with respect to 0 V for simplification of explanation. Moreover, the voltage of the OFF pulse is set at a level where no writing is performed, and the pulse voltage indicates the voltage of the ON pulse.

FIGS. 7A to 7D illustrate exemplary examples of voltage pulses in this method, and depicts voltage pulses and the tone condition that varies by applying them. Here, a writing method in which a tone is set by varying a pulse width of a voltage signal to be applied is called Pulse Width Modulation (PWM) method.

Figures 7A, 7B, 7C, 7D:
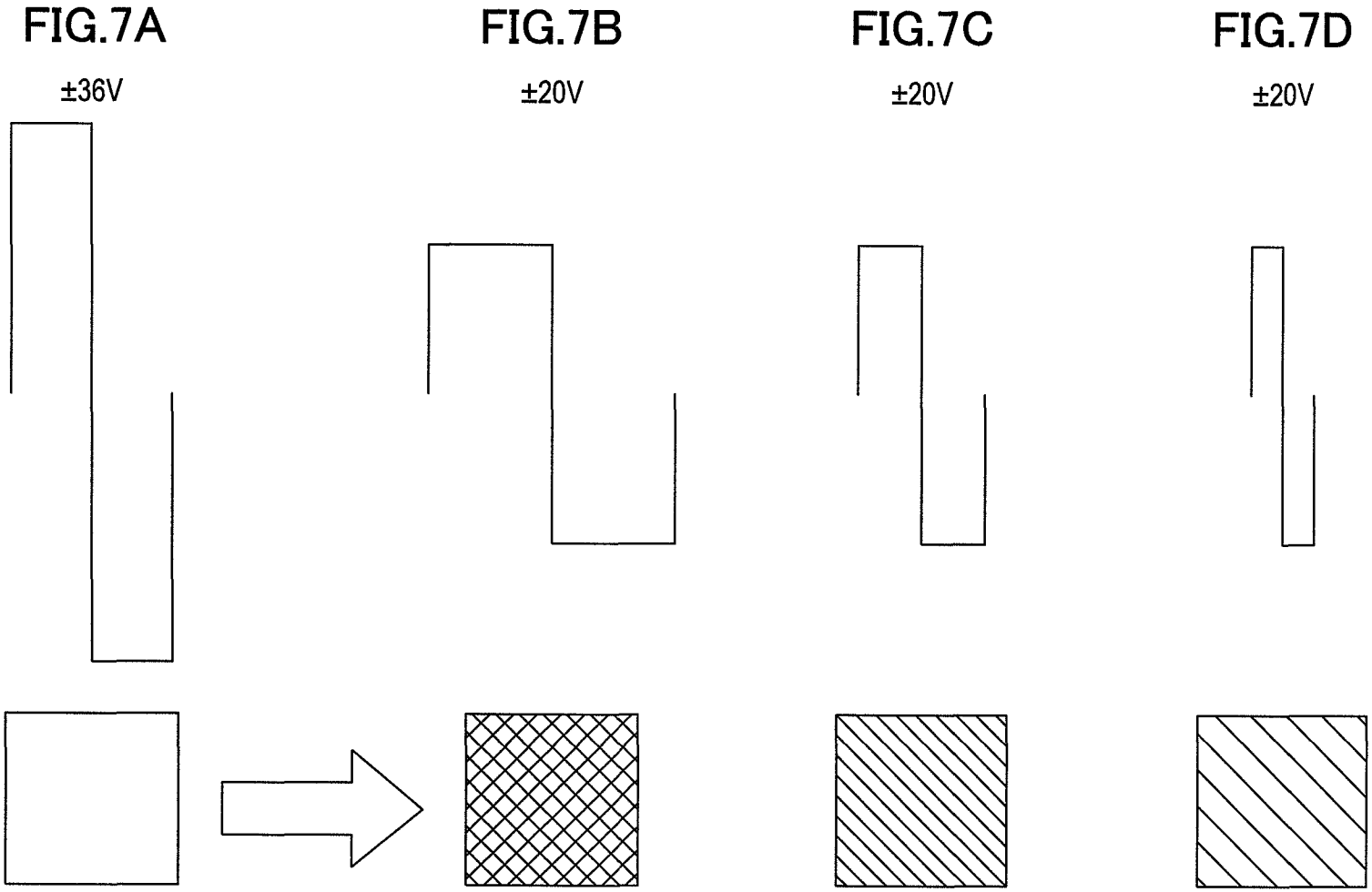
FIGS. 7A to 7D illustrate examples of an initialization pulse and a plurality of tone pulses of different pulse widths being applied to a liquid crystal.

FIG. 7A illustrates, as an example, an initialization pulse used at the first step. The pulse voltage is ±36 V, and has a comparatively large pulse width. By applying this pulse, the liquid crystal of the pixels is brought into the planar state, and the tone is highest. FIGS. 7B to 7D illustrate an example of first to third tone pulses used at the second step. Although the pulse voltages thereof are all ±20 V, the pulse width is shorter in the order of the first to third tone pulses. When the pulses of FIGS. 7B to 7D are applied, in the pixels, the liquid crystal is partly brought from the planar state to the focal conic state to decrease the tone, and the degree of tone decrease is lower in the order of FIGS. 7B to 7D. In other words, when the pulses of FIGS. 7B to 7D are applied, the tone becomes relatively low, intermediate, and high, respectively. In this description, the pulse depicted in FIG. 7B is referred to as a low tone pulse, the pulse depicted in FIG. 7C, as an intermediate tone pulse, and the pulse depicted in FIG. 7D, as a high tone pulse. While only four tones can be expressed by applying any one of the pulses of FIGS. 7B to 7D or applying none of them, the three kinds of pulses depicted in FIGS. 7B to 7D may be combined. For example, by combining a number, n, of periods T into one line period nT and selecting the pulse width in each period T, a multiplicity of tones can be expressed. Moreover, by performing the tone pulse application for a plurality of frames and selecting whether any one of the pulses of FIGS. 7B to 7D is applied or none of them is applied for each frame, a multiplicity of tones can be expressed.

First, driving conditions of the display apparatus according to an embodiment will be described.

Figure 8:
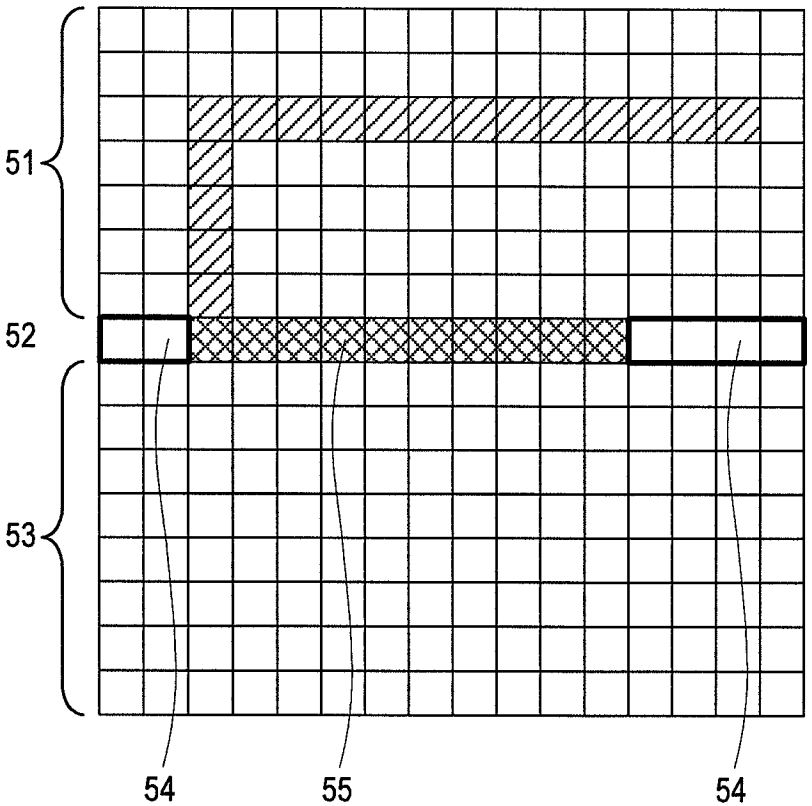
FIG. 8 illustrates an exemplary schematic diagram illustrating a state in which an image is being written on a screen of a display apparatus.

FIG. 8 illustrates, as an example, a state of writing image in a simple matrix type liquid crystal display apparatus employing cholesteric liquid crystal when the device is passively driven. FIG. 8 illustrates, as an example, an alphabet "F" being written by scanning a display device sequentially from the upper part to the lower part. One line indicated by a reference numeral 52 is a selected line. A common driver applies a scan pulse to the selected line 52; thereby writing is performed to pixels on the selected line 52. A plurality of lines 51 located above the selected line 52 are lines to which writing are completed. A plurality of lines 53 located under the selected line 52 is lines to which writing are to be applied. The lines 51 and 53 are non-selected lines. Among selected lines 52, pixels indicated by a reference numeral 55 is all-selected pixel to which writing is applied, and the remaining pixels indicated by a reference numeral 54 are half-selected pixels to which writing are not applied. For example, as illustrated in FIG. 5B, a pulse of ±20 V is applied to an all-selected pixel, a pulse of ±10 V is applied to a half-selected pixel, and a pulse of ±5 V is applied to a non-selected pixel.

Figure 9:
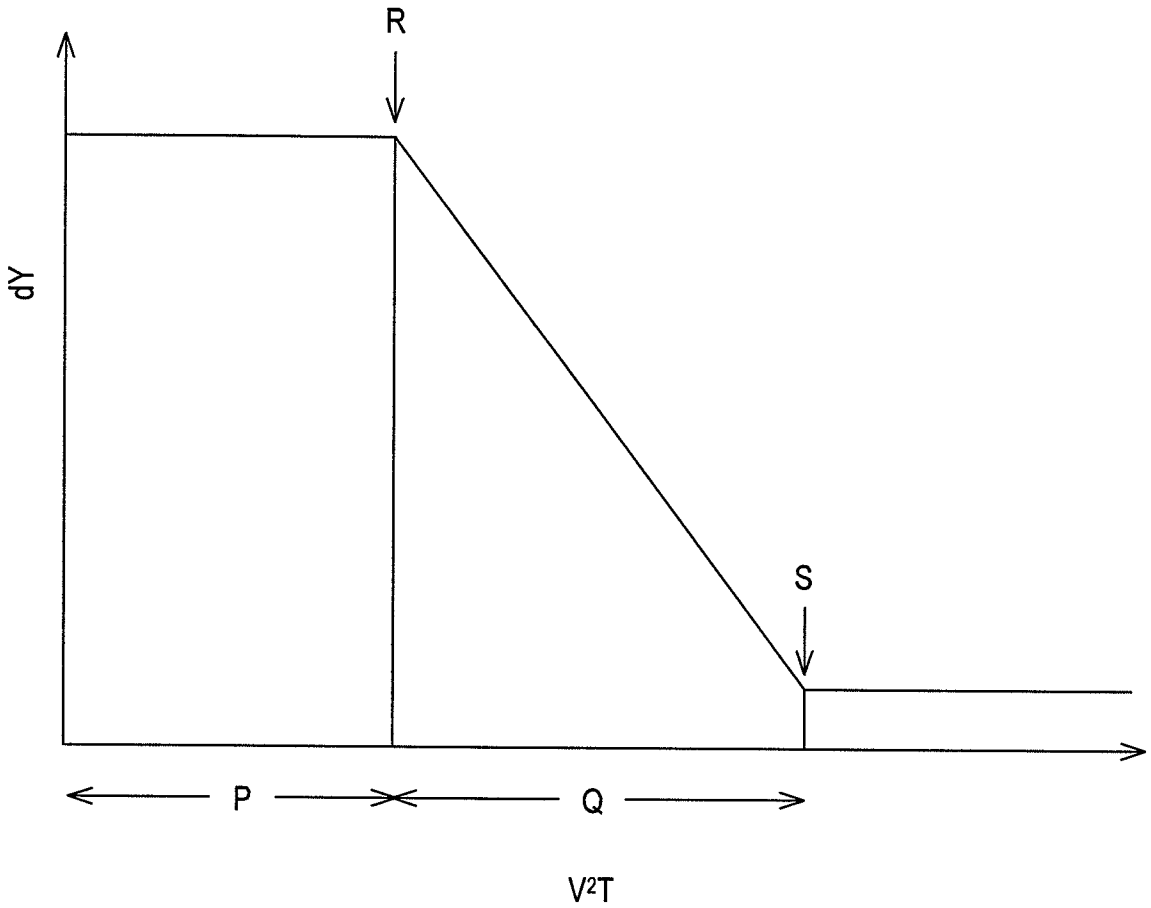
FIG. 9 schematically depicts the response characteristic (brightness decrease) of cholesteric liquid crystal with respect to a pulse voltage applied to a liquid crystal in a writing processing of an embodiment.

FIG. 9 illustrates, as an example, a view schematically depicting the voltage pulse—response characteristic of a cholesteric liquid crystal. The horizontal axis represents a square of a pulse voltage, $V^2$, whereas the vertical axis represents the response amount expressed by a change amount dY of the brightness of the liquid crystal for applied pulses. As described above, a change in brightness of the liquid crystal for the applied pulse is correlated with the pulse width and here; for example, 5 to 10 pulses of 2 ms are combined to obtain several tens ms of pulses in total. The inventor of the present application has found, from the research results obtained heretofore, a cholesteric liquid crystal display apparatus exhibits substantially the same response even for different V or T as long as a pulse voltage V and a pulse width T are within a similar condition as described above, and energy $V^2T$ to be applied is a constant value. Thus, even when the horizontal axis is represented by $V^2T$, the response characteristic depicted in FIG. 9 may be obtained.

As illustrated in FIG. 9, in an area P where V is smaller than a threshold value R, the liquid crystal does not respond, and dY does not change. In an area, where V is larger than the threshold value R, dY changes in proportion to $V^2T$. If $V^2T$ exceeds a value S, the change of dY becomes saturated, and thereby dY does not change any further.

When setting driving conditions of the display apparatus, above described pulse voltages of "non-selected" and "half-selected" are assigned to an area P because "non-selected" and "half-selected" require that dY does not change, whereas a pulse voltage of "all-selected" is assigned to an area Q.

As described above, general-purpose drivers for simple matrix such as those for STN is used as a common driver and a segment driver in terms of cost. However, such general purpose drivers may not freely set voltages of "all-selected," "half-selected," and "non-selected," and have certain limitations. For example, when "all-selected" voltage for writing is assumed to be constant, there are the following relationships: decreasing "half-selected" voltage increases "non-selected" voltage, while increasing "half-selected" voltage decreases "non-selected" voltage. Moreover, there is a drawback in that an output voltage of a general-purpose driver is approximately 40 V and drivers that output 40 V or more are custom ordered, substantially increasing cost.

Therefore, it is important to shorten a writing time within the voltage range in order to achieve faster writing speed while maintaining advantages of the conventional driving method such as high display quality and low cost.

Moreover, lowering a non-selected voltage is important as well. In writing operation, an all-selected voltage and a half-selected voltage may be applied to only one line, and a non-selected voltage is applied to most of the other lines. Thus, a power consumption of a display panel is mostly defined by charging and discharging power of non-selected pixels. Accordingly, lowering a non-selected voltage is important for suppressing power consumption that increases with improvement of writing speed. This desire to lower non-selected voltage, conversely, means that a smaller voltage difference between all-selected and half-selected is desirable. The above described matter is summarized as follows.

Relationship of all-Selected Voltage, Half-Selected Voltage, and Non-Selected Voltage Relationship 1

All-selected voltage: voltage for writing tones

Half-selected voltage and non-selected voltage: voltage for maintaining tones

Relationship 2

All-selected voltage ≦40V, All-selected voltage=half-selected voltage+non-selected voltage×2

Response Characteristics of Cholesteric Liquid Crystal

Relationship 3

$dY=V^2T$ (dY=a change amount of brightness, V=pulse voltage, T=pulse width)

Thus, when T is constant, dY is proportional to $V^2$

According to research results, it is found that the following two factors influence the shortening of writing time: (i) the length of the area P where liquid crystal does not respond, and (ii) inclination of the area Q where liquid crystal responds.

Figure 10:
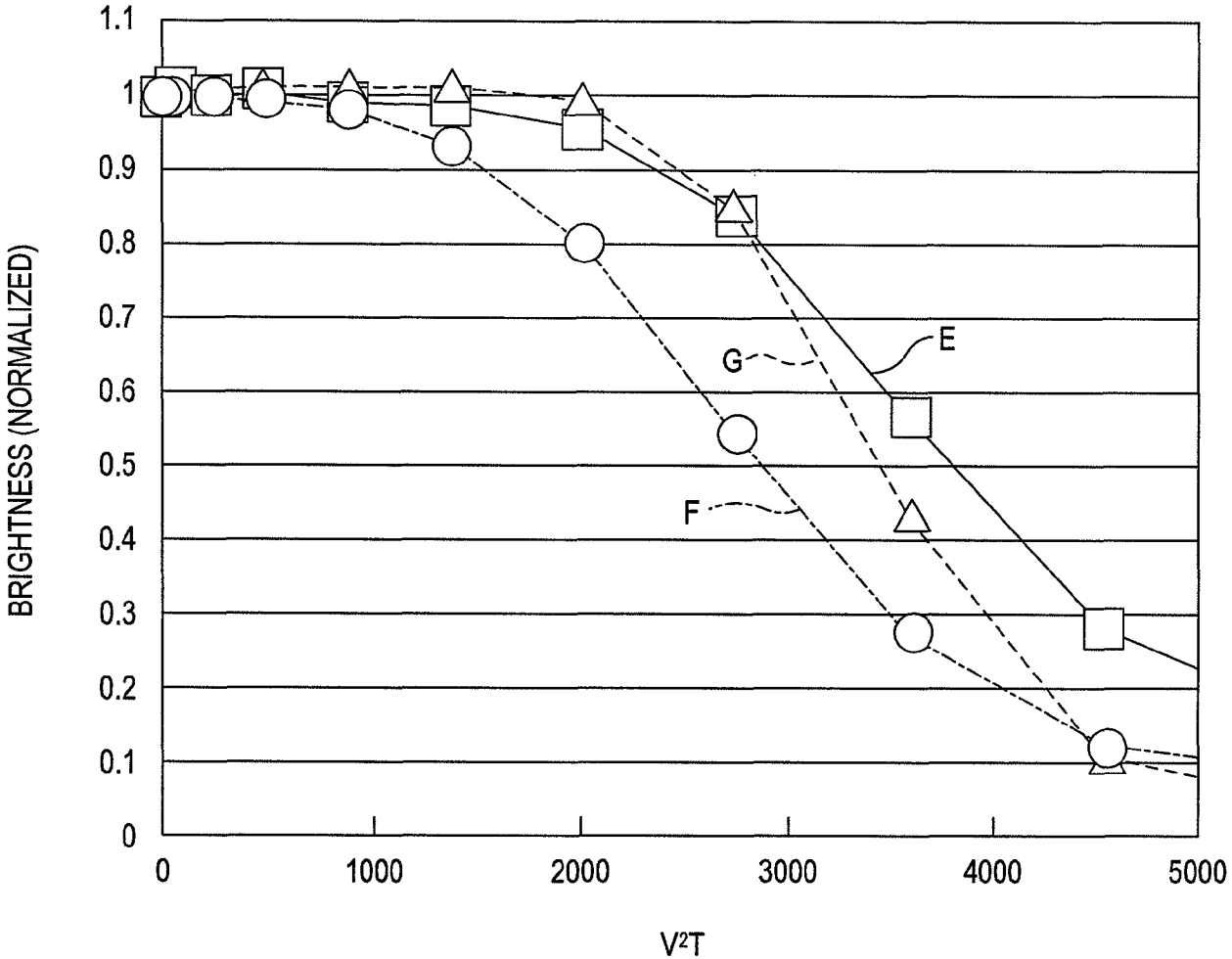
FIG. 10 illustrates an exemplary graph depicting data obtained by measuring the time required for writing to a plurality of display panels prepared with different configurations by writing tones with a combination of all-selected voltage, a half-selected voltage, and a non-selected voltage under a condition in which no crosstalk is caused and good contrast is obtained.

Time required for writing is measured as follows. Various kinds of display panels with different configurations are prepared. Under a condition that no crosstalk is caused and good contrast is obtained, tone writing is performed for each of the display panel by applying various combinations of all-selected voltage, half-selected voltage, and non-selected voltage. FIG. 10 represents the results. In FIG. 10, the horizontal axis indicates $V^2T$, while the vertical axis indicates brightness. A display panel that achieves a writing time of around 7 seconds exhibits the response characteristics E in FIG. 10, while a display panel that achieves a writing time of around 10 seconds exhibits the response characteristics F in FIG. 10.

The display panel with the response characteristics E in FIG. 10 achieves writing without crosstalk and with good contrast display under the following condition.

All-selected voltage: ±24 V, half-selected voltage: ±14 V, non-selected voltage: ±5 V, line selection time 9.2 ms/line (writing time is 7 seconds with XGA format)

On the other hand, the display panel with the response characteristics F in FIG. 10 causes crosstalk and displays with poor contrast when writing is performed under the same condition as above, that is all-selected voltage: ±24 V, half-selected voltage: ±14 V, non-selected voltage: ±5 V, line selection time 9.2 ms/line. In order to achieve a display with good contrast without causing crosstalk for the display panel with the response characteristics F, the following condition may be required.

All-selected voltage: ±20 V, half-selected voltage: ±10 V, non-selected voltage: ±5 V, line selection time 15.6 ms/line (writing time is 12 seconds with XGA format)

When the response characteristics of E and F in FIG. 10 are compared, it is found that they are strongly related to the above factors (i) and (ii). $Va^2T$ obtained from an all-selected voltage Va for the maximum value (saturation value) of dY and a line selection time T are the same value (approximately 6000 $V^2$ ms) for both E and F. However, $Vh^2T$ obtained from a half-selected voltage Vh differs for the two display panels; that is 2000 $V^2$ ms for the display panel E, and 1500 $V^2$ ms for the display panel F. In order to achieve faster writing, a ratio of $V^2T$ of all-selected voltage to $V^2T$ of half-selected voltage is required to be small. For example, a ratio of $V^2T$ of all-selected voltage to $V^2T$ of half-selected voltage is 3 for the display panel with response characteristics E, while 4 for the display panel with response characteristics F, and the ratio is required to be smaller than 4. In order to satisfy this condition, a length of the area P is required to be long, and an inclination of the graph in the area Q is required to be steep.

A preferable response characteristics G of display panel is illustrated in FIG. 10. An example of preferable response characteristics G is a display panel with XGA format in which a display with good contrast is obtained without crosstalk when writing time is assumed to be 5 seconds. As illustrated in FIG. 10, a ratio of $V^2T$ of all-selected voltage and $V^2T$ of a half-selected voltage of the response characteristics G is further smaller than that of the response characteristics E.

Figure 11:
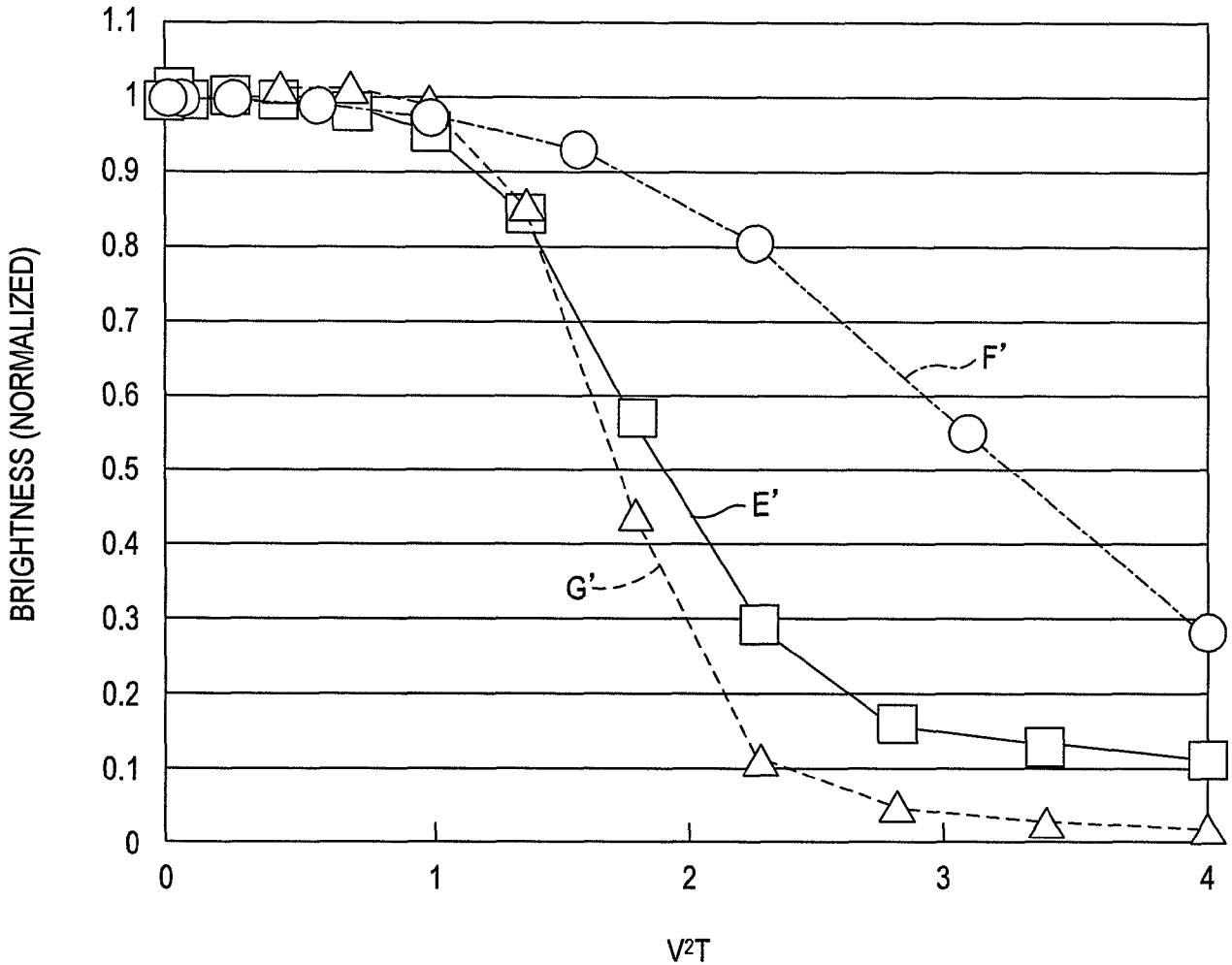
FIG. 11 illustrates the exemplary results depicted in FIG. 10 by normalizing the data.

For easier comparison of the above described relationships, FIG. 11 illustrates exemplary graphs E', F', and G' obtained by normalizing $V^2T$ of graphs E, F, and G in FIG. 10 to $V^2T'$ so that the maximum voltages (corresponds to R in FIG. 9) of an area P become substantially the same. The relationship of writing speed and a ratio of $V^2T$ of all-selected voltage to $V^2T$ of half-selected voltage is more clearly understood from the graphs in FIG. 11. The reason why the smaller the ratio, the more advantageous it is to shorten a writing time is strongly related to the above-described relationships of 1 to 3 regarding all-selected voltage, half-selected voltage, and non-selected voltage.

For example, raising an all-selected voltage enables writing in short time; however, this requires raising a half-selected voltage as well. The half-selected voltage is required not to exceed the maximum voltage of the area P (R in FIG. 9). On the other hand, lowering the half-selected voltage increases the non-selected voltage. Non-selected voltages are almost always applied to all pixels. Thus, raising the non-selected voltage increases the possibility of causing crosstalk. Moreover, as described above, lowering non-selected voltage is preferable in terms of lowering power consumption. Accordingly, lowering non-selected voltage is prioritized. Therefore, a non-selected voltage has to be fixed low, and an all-selected voltage has to be raised together with a half-selected voltage.

FIG. 12 illustrates the above-described relationship. In order to obtain a good contrast display without crosstalk, the display panel with characteristics F in FIG. 11 is set so that the all-selected voltage is ±20 V, the half-selected voltage is ±10 V, and the pulse width T is 5 ms. At this time, the $V^2T$ is 2000 $V^2$ ms for the all-selected voltage, while 500 $V^2$ ms for the half-selected voltage. When the all-selected voltage is raised from ±20 V to ±25 V in order to shorten writing time, the half-selected voltage is required to be raised from ±10 V to ±15 V to maintain non-selected voltage to ±5 V. In this case, $V^2T$ of the all-selected voltage is 2000 $V^2$ ms, while $V^2T$ of the half-selected voltage is 720 $V^2$ ms that exceeds the maximum voltage of the area P to enter the area Q. Therefore, the condition may not be applied.

The display panels with characteristics E and G in FIG. 11 may shorten a writing time even if $V^2T$ of the half-selected voltage is increased due to raising the all-selected voltage and half-selected voltage as described above, because the $V^2T$ of the half-selected voltage is within the area P. Thus the condition may be applied to shorten the writing time.

Conversely, considering $V^2T$ of half-selected voltage as a standard, a panel with a smaller ratio of $V^2T$ of the all-selected voltage to $V^2T$ of the half-selected voltage may obtain a given amount of liquid crystal response by a smaller $V^2T$ compared with a panel with a larger ratio of $V^2T$ of the all-selected voltage to $V^2T$ of the half-selected voltage. Thus, the writing time is shortened.

As described above, it is found that a smaller ratio of $V^2T$ of the all-selected voltage to $V^2T$ of half-selected voltage is advantageous to shorten the writing time.

On the other hand, a lower limit of a ratio of $V^2T$ of all-selected voltage to $V^2T$ of half-selected voltage is, preferably, 2 or more due to the reasons that will be described below.

Figure 13A:
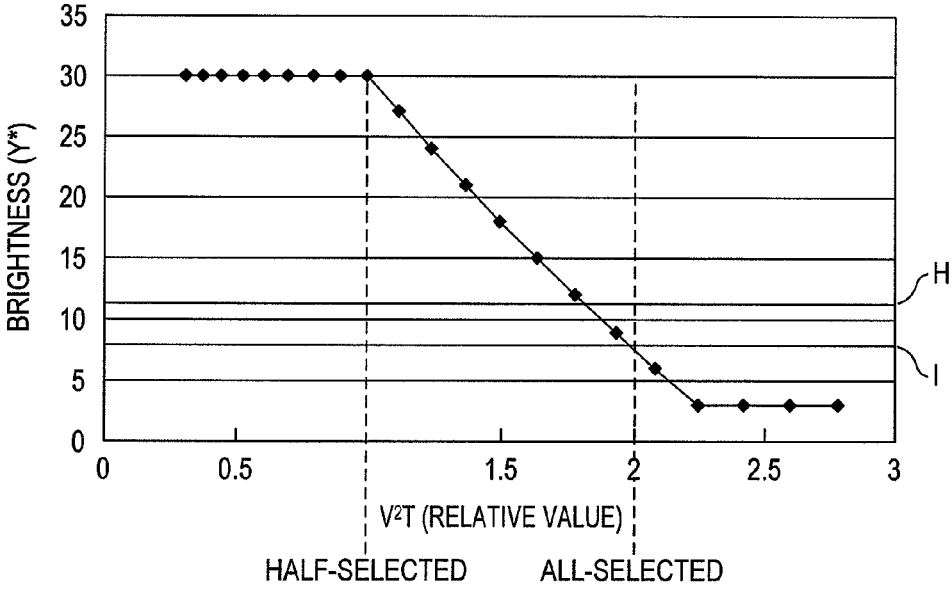
FIGS. 13A and 13B illustrate exemplary graphs for explaining the lower limits of $V^2T$ of all-selected voltages and $V^2T$ of half-selected voltages.
Figure 13B:
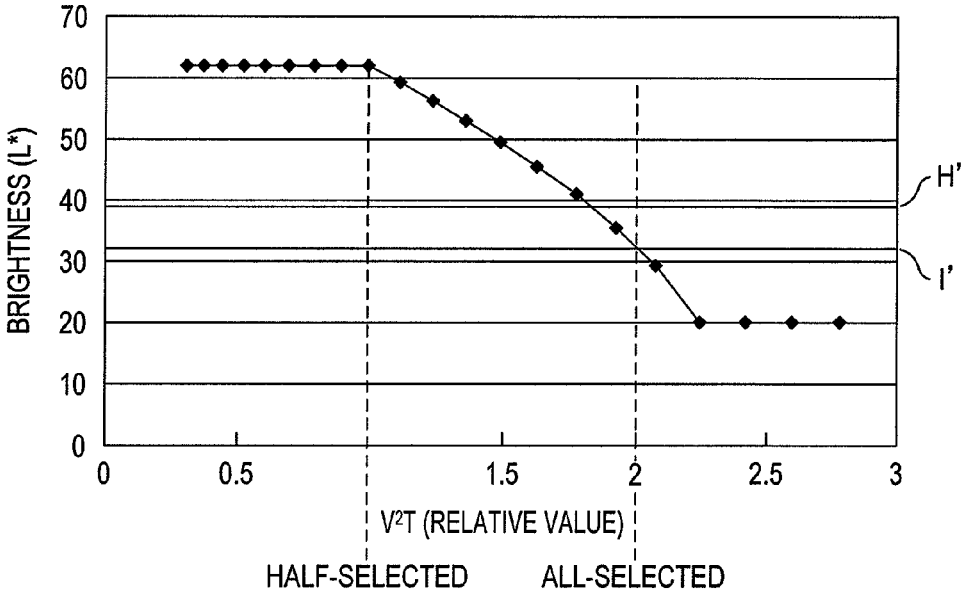

FIGS. 13A and 13B illustrate graphs for explaining the lower limits of $V^2T$ of all-selected voltages and $V^2T$ of half-selected voltages. FIG. 13A represents the response characteristics in terms of brightness Y, while FIG. 13B represents the same response characteristics in terms of brightness indicator L* in a uniform color space.

For example, writing a dark tone near black to a display panel is considered when a center value of a cell gap is 5 μm, and uneven gap in the display area of the display panel is approximately ±2.5° h. Moreover, a ratio of $V^2T$ of all-selected voltage to $V^2T$ of half-selected voltage is assumed to be approximately 2, and the cell gap and the display performance are reviewed.

In this case, a 5% difference in field intensity at a writing process is caused between the place where cell gap is the smallest, 4.875 μm and where the cell gap is the largest, 5.125 μm and when a center value of all-selected voltage is ±25 V, and effective voltages are ±24.4 V, and ±25.6 V respectively.

It is assumed that standard display performance in general is assumed to be brightness 30%, and contrast is assumed to be 10 or less.

Areas where voltages are ±24.4 V, and ±25.6 V, the response amount of liquid crystal (brightness) are different, and brightness Y after applying these voltage pulses are approximately 10.9 and 7.9 respectively, and represented by H and I in FIG. 13A. Conversion of these values into a uniform color space L* results in 39.3 and 33.5 respectively, and levels represented by H' and I' in FIG. 13B. Moreover, the brightness Y is approximately 9 and L* is 36 in an area where a center value is ±25 V.

There are, for example, the following indicators for color differences (ΔE) in L*a*b color space.

ΔE: 0 to 0.5 slight color difference (trace)

ΔE: 0.5 to 1.5 slight color difference (alight)

ΔE: 1.5 to 3.0 noticeable color difference (noticeable)

ΔE: 3.0 to 6.0 appreciable color difference (appreciable)

ΔE: 6.0 to 12.0 much color difference (much)

ΔE: 12.0 or more very much color difference (very much)

For L* value, assuming the above described center value 36 as a standard, an area with the narrowest cell gap is 33.5 and, therefore, the difference from the center value is −2.5, while an area with the widest cell gap is 39.3 and the difference from the center value is 3.3. In other words, this case applies to the above "ΔE: 1.5 to 3.0 noticeable color difference (noticeable)", and within an allowable range of display quality and reliability. When a ratio of $V^2T$ of all-selected voltage to $V^2T$ of half-selected voltage is smaller than this, ΔE due to an uneven cell gap increases, and uneven tone becomes conspicuous. Therefore, the appropriate lower limit of a ratio of $V^2T$ of all-selected voltage to $V^2T$ of half-selected voltage is approximately 2 considering the current standard display performance.

As described above, the ratio of $V^2T$ of all-selected voltage to $V^2T$ of half-selected voltage is preferably within a range of 2 to 4. Pulse widths are the same when a display apparatus is passively driven using an STN driver, in this case the above condition is as follows: Va/Vb that is a ratio of all-selected voltage Va to $V^2T$ of half-selected voltage Vb is larger than $2^{1/2}$ and smaller than 2. Such voltage condition has not been applied to any conventional passively driven display apparatus using material with a memory function.

Characteristics of a display panel that enables to improve a writing speed under the above ratio condition of $V^2T$ of all-selected voltage to $V^2T$ of half-selected voltage are defined by liquid crystal material or a panel structure. Hereunder, a display panel configuration will be described that achieves a ratio of $V^2T$ of all-selected voltage to $V^2T$ of half-selected voltage is larger than $2^{1/2}$ and smaller than 2; in other words, a ratio of $V^2T$ of all-selected voltage to $V^2T$ of half-selected voltage is within a range of 2 to 4 will be described for an exemplary embodiment.

Figure 14:
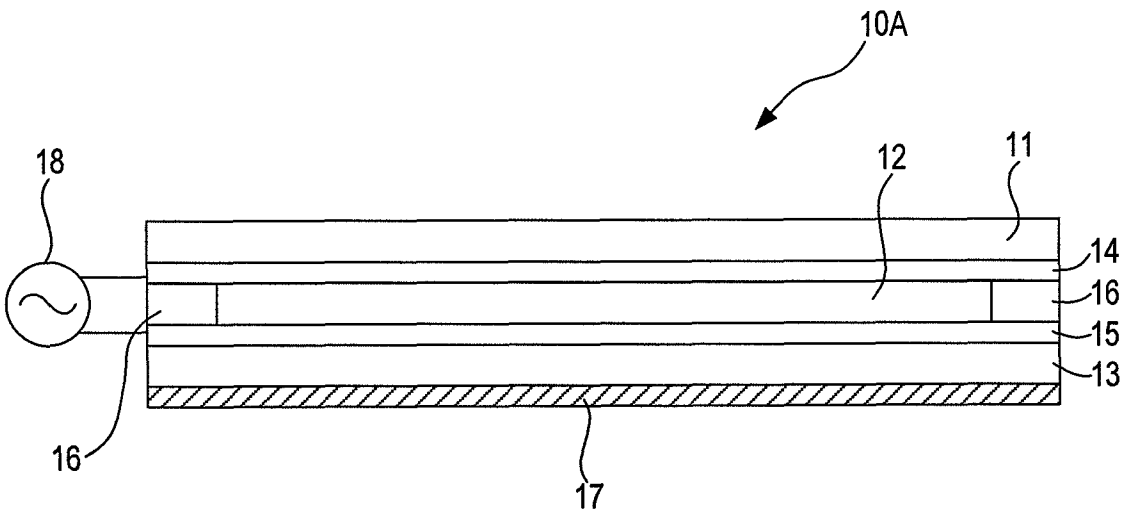
FIG. 14 illustrates an exemplary the structure of the cholesteric liquid crystal element of an embodiment of a color display apparatus.

FIG. 14 illustrates a cross-section structure of an exemplary embodiment of a display panel 10A. As illustrated in FIG. 14, the display panel 10A includes an upper substrate 11, an upper electrode layer 14 that is provided over the surface of the upper substrate 11, a lower electrode layer 15 provided over the surface of the lower substrate 13 and a seal material 16. Moreover, a visible light absorption layer 17 is provided as required under the lower substrate 13 (outer surface) that is opposite side of where light is incident.

The upper substrate 11 and the lower substrate 13 are disposed so that electrodes are facing each other, and sealed with the seal material 16 after filling liquid crystal material between the upper substrate 11 and the lower substrate 13. Although, not illustrated, spacers are disposed within a liquid crystal layer 12. A driver circuit 18 applies voltage pulse signals to electrodes of the upper electrode layer 14 and the lower electrode layer 15; thereby a voltage is applied to the liquid crystal layer 12. The liquid crystal layer 12 is liquid crystal composition that exhibits a cholesteric phase, and applying a voltage to the liquid crystal layer 12 makes liquid crystal molecules align into the planar state or the focal conic state to perform display.

While the upper substrate 11 and the lower substrate 13 both have translucency, the lower substrate 13 may be opaque. While an example of the translucent substrate is a glass substrate, a film substrate of polyethylene terephthalate (PET), polycarbonate (PC), or the like may be used as well as the glass substrate.

While a representative example of the material for the electrodes of the upper electrode layer 14 and the lower electrode layer 15 is indium tin oxide (ITO), a transparent conductive film of indium zinc oxide (IZO) or the like may be used as well.

The transparent electrodes of the upper electrode layer 14 are formed on the upper substrate 11 as a plurality of strip-shaped upper transparent electrodes parallel to one another. The transparent electrodes of the lower electrode layer 15 are formed on the lower substrate 13 as a plurality of strip-shaped lower transparent electrodes parallel to one another. The upper substrate 11 and the lower substrate 13 are disposed so that the upper electrodes and the lower electrodes intersect each other when viewed from a direction vertical to the substrate, and pixels are formed at the intersections.

An insulative thin film is formed on the electrodes. When this thin film is thick, the drive voltage may increase; therefore, it becomes difficult to form the driver circuit of a general-purpose STN driver. Conversely, when no thin film is formed, a leakage current may flow, and thus power consumption may increase. In this example, since the relative dielectric constant of the thin film is approximately 5.0, which is considerably lower than that of the liquid crystal, it is appropriate that the thickness of the thin film be 0.3 μm or less.

The insulative thin film may be realized by an $SiO_2$ thin film or an organic film of polyimide resin, acrylic resin or the like known as an orientation stabilization film.

This insulative thin film is substantially advantageous to make an alignment layer with a low pretilt angle achieve the above described factors (i) and (ii) with good balance, and to make a ratio of $V^2T$ of all-selected voltage to $V^2T$ of half-selected voltage to a range of 2 to 4. A pretilt angle, here, means that an angle formed by a molecule of nematic liquid crystal which does not form a helical structure to the interface.

Figure 15:
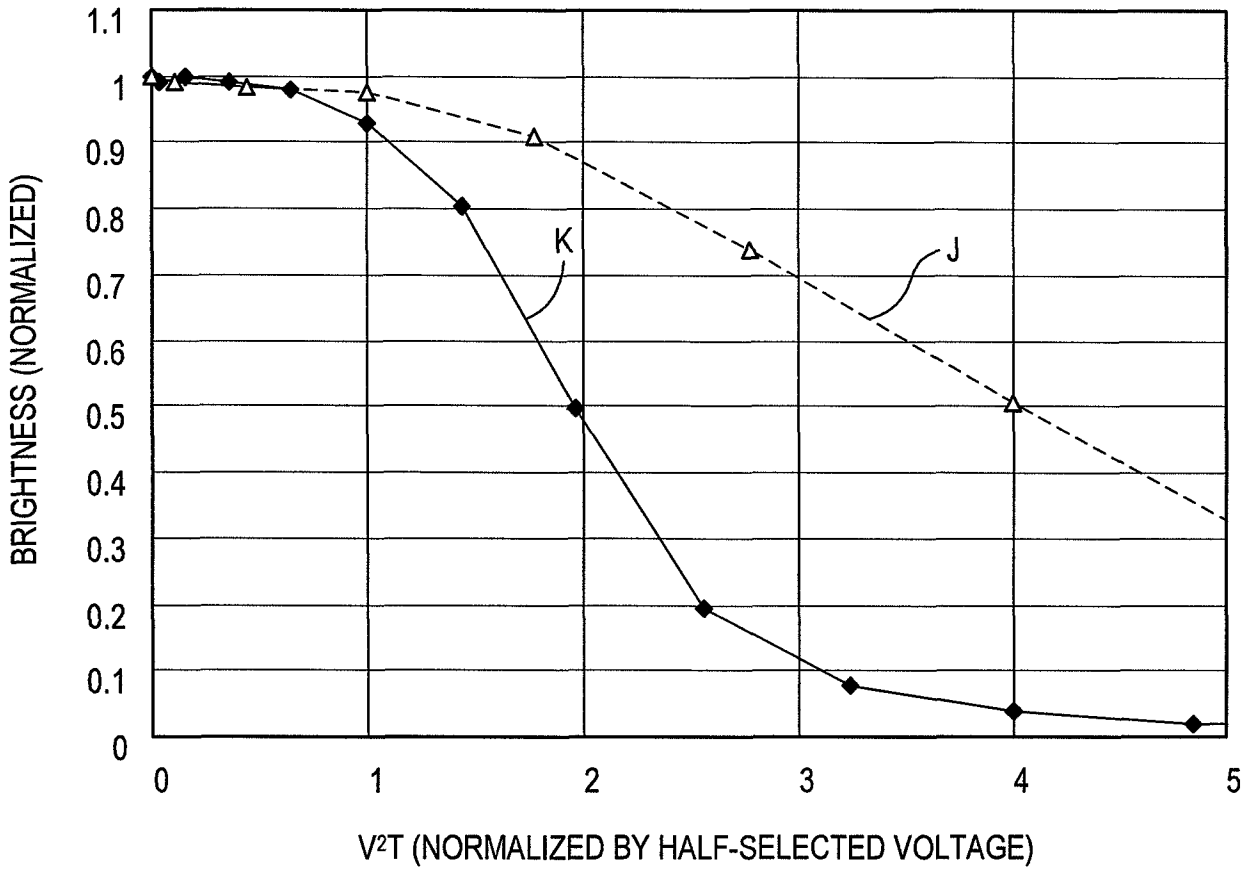
FIG. 15 illustrates an exemplary graph depicting response characteristics J of a panel to which no processing is applied to obtain a given pretilt angle, and response characteristics K of a panel to which processing is applied to an alignment layer in the panel to obtain a given pretilt angle for an embodiment.

FIG. 15 illustrates exemplary response characteristics J of a panel to which no processing is applied to obtain a given pretilt angle, and response characteristics K of a panel to which processing is applied to an alignment layer in the panel to obtain a given pretilt angle. Here, response characteristics in an area Q are represented by normalizing so that the half-selected voltages become substantially the same. Response characteristics J and K in FIG. 15 indicate that the inclination of the graph for the panel to which an alignment layer with a low pretilt angle is applied is steeper in the area Q; this means response characteristics are improved. On the other hand, response characteristics of the panel to which an alignment layer with a high pretilt angle is applied are not improved. According to experiment results, a range of low pretilt angles of an alignment layer is preferably approximately 0.5° to 8°.

Now, spacers will be described. As described above, spacers are disposed in the liquid crystal layer 12 so that the distance between the upper substrate 11 and the lower substrate 13, that is, the thickness of the liquid crystal layer 12 is uniform. While spacers are typically spheres made of a resin or an inorganic oxide, adhesive spacers where the substrate surfaces are coated with a thermoplastic resin may be used. It is appropriate that the cell gap formed by the spacers be in a range of 3.5 μm to 6.0 μm. When the cell gap is smaller than this value, the reflectance is decreased to make the display dark, and when the cell gap is larger than this value, the drive voltage is increased to make driving by a general-purpose driver difficult.

Figure 16:
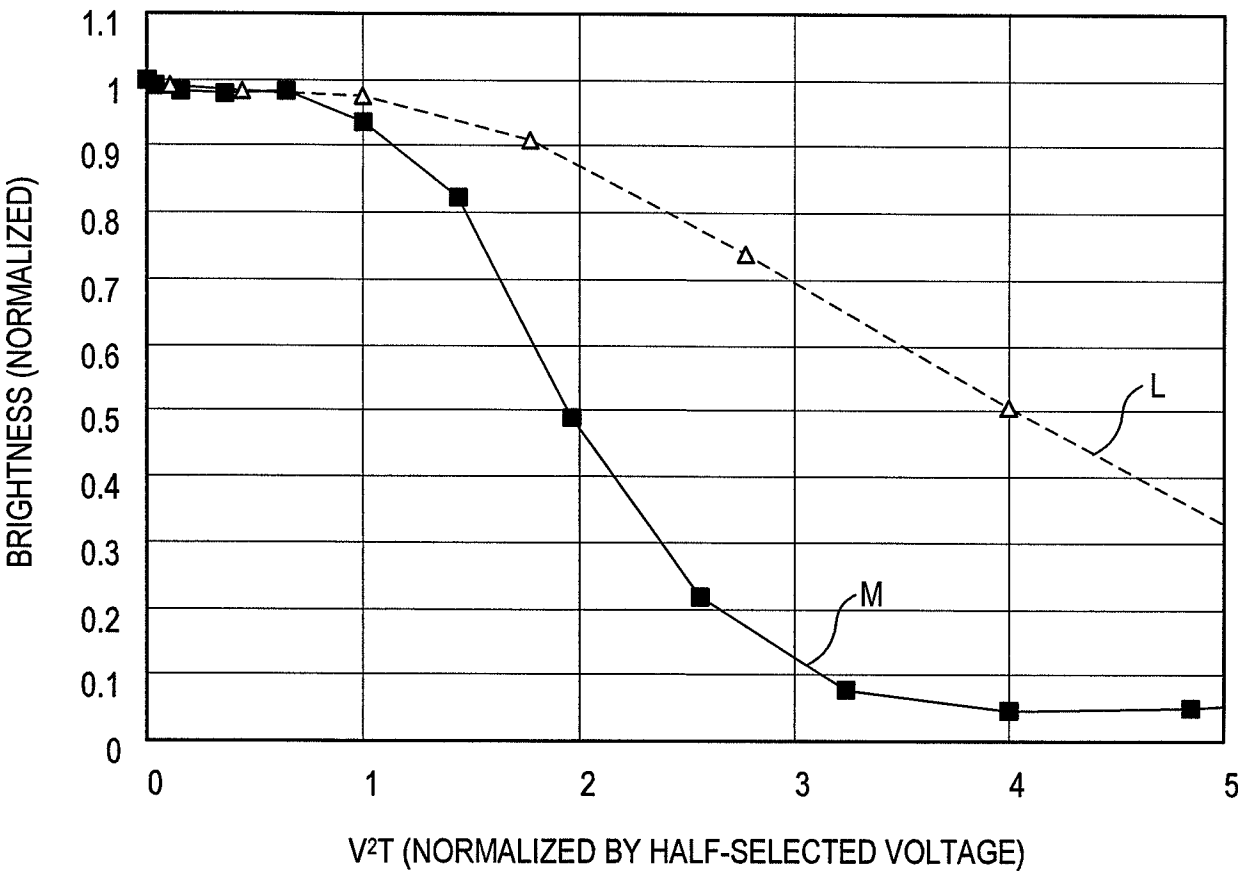
FIG. 16 illustrates an exemplary graph depicting response characteristics of a plurality of embodiments of panels with different thicknesses of a liquid crystal layer 12.

FIG. 16 illustrates exemplary response characteristics of panels with different thicknesses of liquid crystal layer 12. The reference numeral L indicates response characteristics of a panel with a thickness of 4.4 μm, while the reference numeral M indicates response characteristics of a panel with a thickness of 4.8 μm that is 10% increase of the thickness 4.4 μm. As illustrated in FIG. 16, by thickening the liquid crystal layer 12, the inclination of the area Q increases, and the response characteristics are improved. Thicker the liquid crystal layer 12, larger a bulk area which is not influenced by the interface is; thus the response characteristics are improved and inclination of the area Q is increased. Moreover, this inclination logarithmically increases with the thickness of the liquid crystal layer.

The liquid crystal constituent forming the liquid crystal layer 12 is a cholesteric liquid crystal in which 10 wt % to 40 wt % of chiral material is added to a nematic liquid crystal mixture. Here, the addition amount of the chiral material is the value when the total amount of the nematic liquid crystal component and the chiral material is 100 wt %.

While various known kinds of substances may be used as the nematic liquid crystal, it is desirable that the nematic liquid crystal be a liquid crystal material with a dielectric anisotropy ($\Delta\in$) of 15 to 35. If dielectric anisotropy is 15 or less, the overall driving voltage becomes high, and thereby a general-purpose driver may not be used for a driver circuit.

On the other hand, if dielectric anisotropy is 15 or more, the above described area P becomes smaller, and it is considered that a ratio of $V^2T$ of all-selected voltage to $V^2T$ of half-selected voltage becomes large. In this case, a reliability problem of the liquid crystal material itself may occur.

It is desirable that the refractive index anisotropy ($\Delta n$) be 0.18 to 0.26. When the refractive index anisotropy is lower than this range, the reflectance in the planar state is low, and when the refractive index anisotropy is higher than this range, not only the diffuse reflectance in the focal conic state is high but also the viscosity is high and the response speed is low.

A ratio of $V^2T$ of all-selected voltage to $V^2T$ of half-selected voltage may be set to 2 to 4 by setting at least two of the above described pretilt angle, thickness of liquid crystal layer, and dielectric anisotropy to the above values.

Changing a panel structure and setting a ratio of $V^2T$ of all-selected voltage to $V^2T$ of half-selected voltage to a desirable range are described above. It is found that the ratio is dependent on a frequency of an applied pulse. The dependence will be described by referring to FIGS. 17 and 18.

Figure 17:
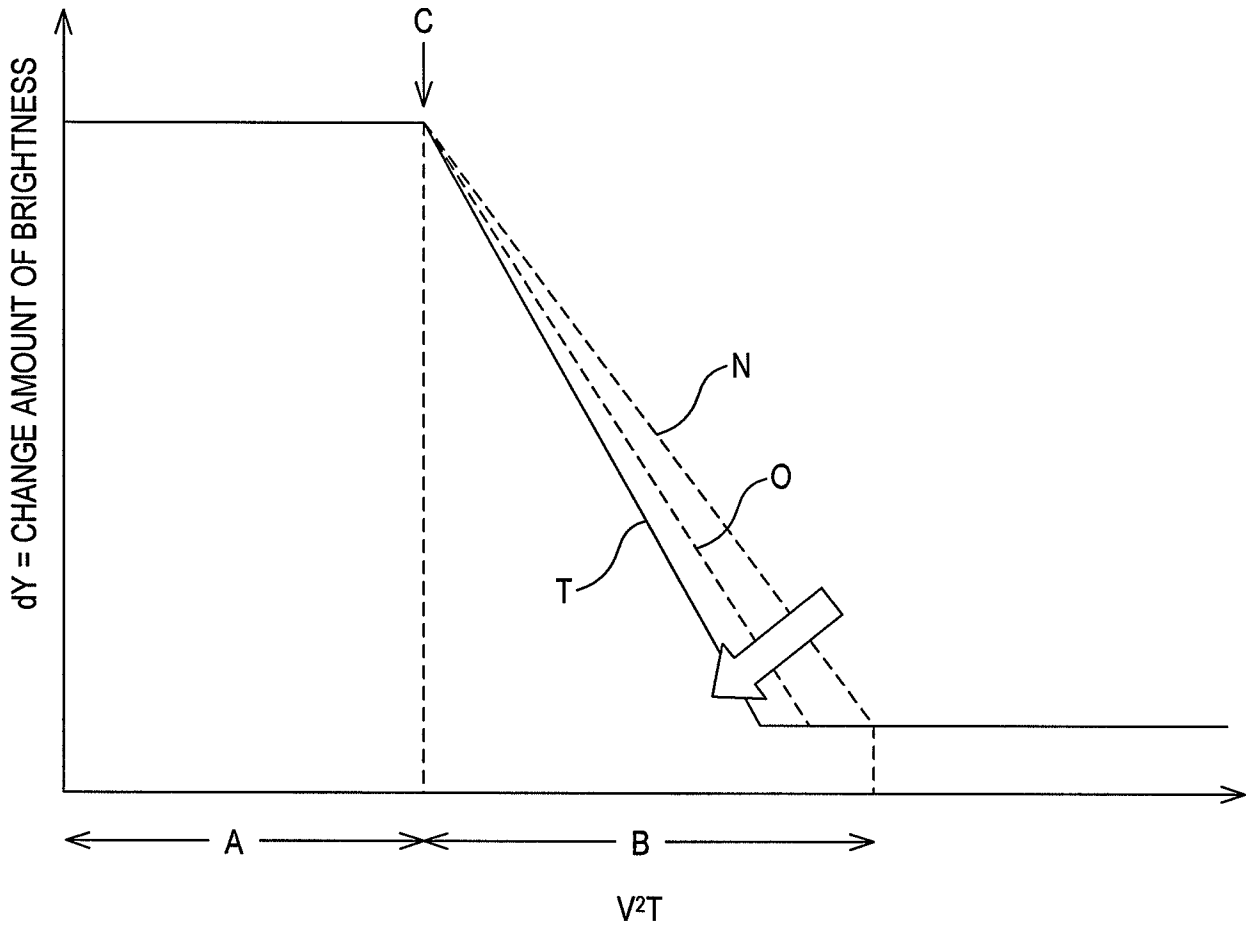
FIG. 17 illustrates a schematic diagram depicting response characteristics when waveforms with three different frequencies are applied with the same cumulative time of pulse application in accordance with an exemplary embodiment.
Figure 18A:
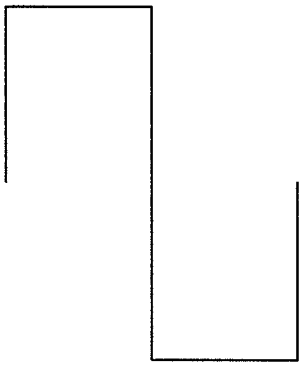
FIGS. 18 A to 18C illustrate examples of a low frequency, a medium frequency and a high frequency pulses that are used for obtaining response characteristics in the embodiment illustrated in FIG. 17.
Figure 18B:
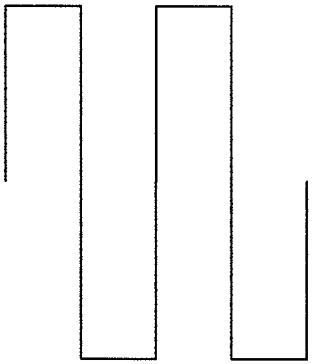
Figure 18C:
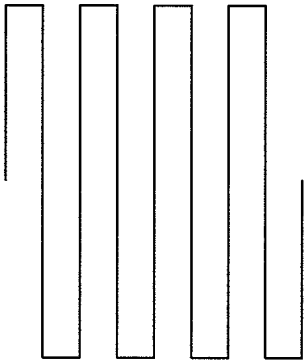

FIG. 17 illustrates exemplary response characteristics when waveforms with three different frequencies are applied with the same cumulative time of pulse application. FIG. 18 illustrates exemplary examples of low frequency, medium frequency and high frequency pulses that are used for obtaining response characteristics in FIG. 17.

In FIG. 17, the reference numeral N depicts response characteristics when a conventional low frequency pulse is applied, the reference numeral O depicts when a medium frequency pulse is applied, and the reference numeral T depicts response characteristics when a high frequency pulse is applied.

FIG. 17 illustrates that inclination of the area Q is steeper when frequency is higher even if the pulse application time is the same in an exemplary embodiment. Thus, a ratio of $V^2T$ of all-selected voltage to $V^2T$ of half-selected voltage may be a range between 2 to 4. This frequency dependency is assumed due to influence by ionic material in a liquid crystal layer. For example, in the case of a low frequency pulse, ions move to a direction that negates an electric field applied from the outside, and causes a loss of field intensity. Conversely, in the case of a high-frequency pulse, ions may not follow, and thus, a loss of field intensity may decrease. Accordingly, removing ionic material may be considered; however, the ionic material may not be completely removed even if refining in manufacturing process is improved, and some ionic material may remain in the liquid crystal layer. Particularly, a panel manufactured with a film substrate tends to include more ionic material compared with those manufactured with a glass substrate. A ratio of ionic material in a cholesteric liquid crystal is relatively higher compared with that of other liquid crystal.

Figure 19A:
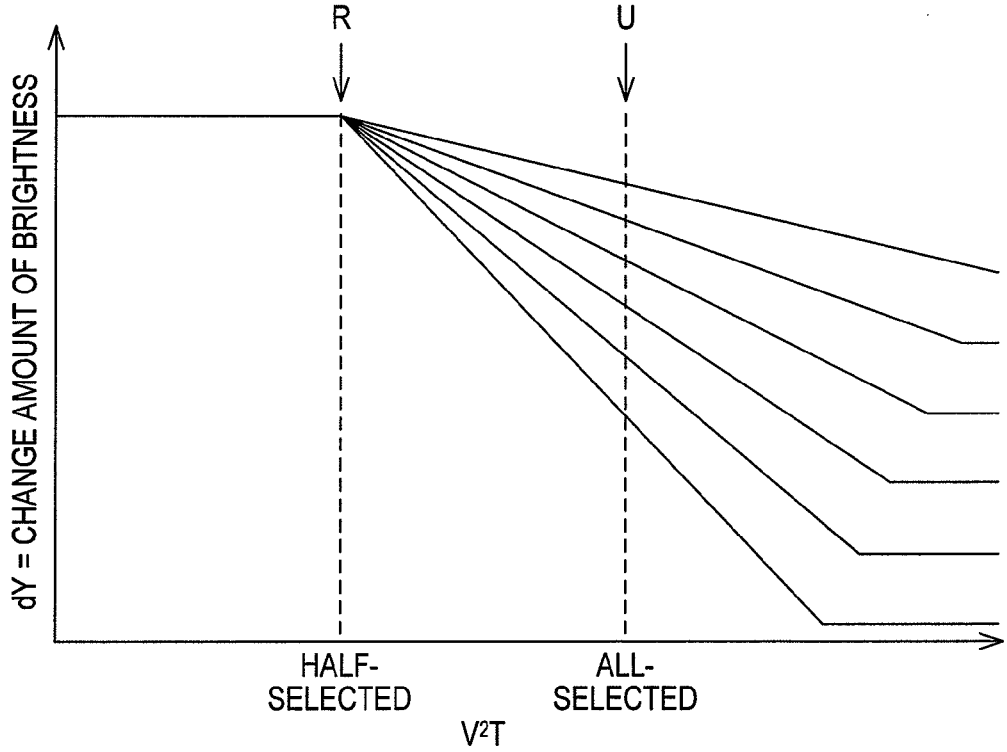
FIGS. 19A and 19B illustrate exemplary graphs for comparing response characteristics of a low frequency pulse and that of a high frequency pulse.
Figure 19B:
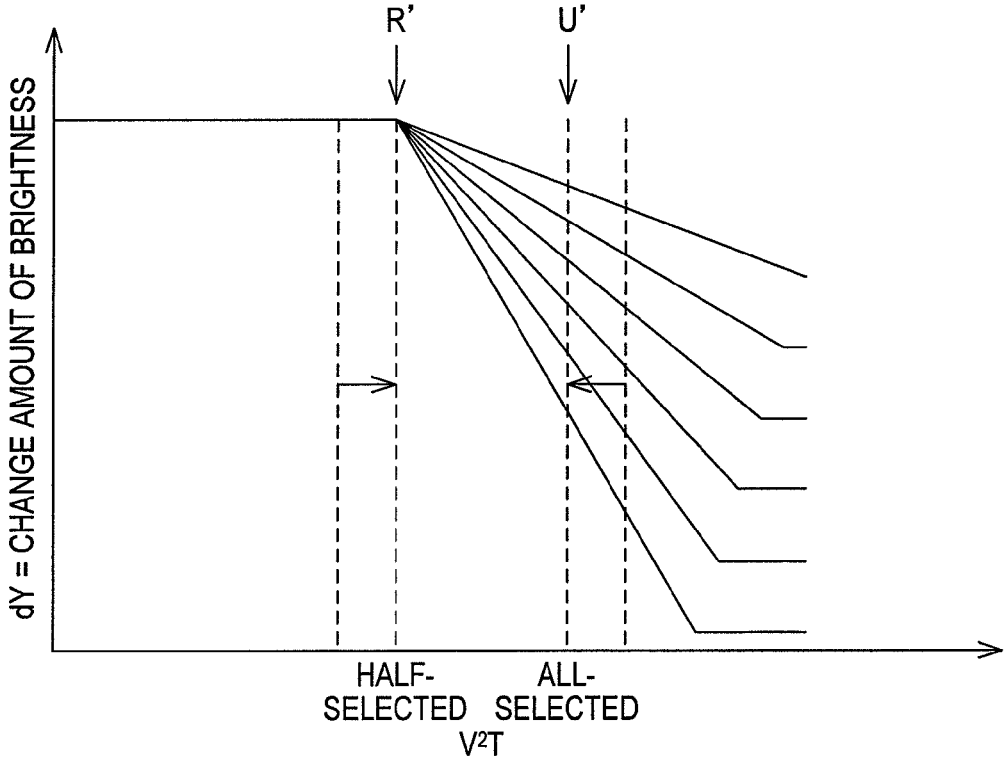

FIGS. 19A and 19B illustrate exemplary graphs to compare response characteristics of a low-frequency pulse and a high-frequency pulse. FIG. 19A illustrates exemplary response characteristics when a low-frequency pulse is applied. FIG. 19B illustrates exemplary response characteristics when a high-frequency pulse is applied. Comparing FIG. 19A with FIG. 19B, a maximum voltage in the area P is R when a low-frequency pulse is applied, whereas that increases to R' which is larger than R when high-frequency pulse is applied. Moreover, inclination of the area Q is steeper when a high-frequency pulse is applied than when a low-frequency pulse is applied. Thus, in order to obtain the same dY, $V^2T$ for a low-frequency pulse is U, whereas $V^2T$ for high-frequency pulse is U' which is smaller than U. As described above, the same writing may be performed with energy $V^2T$ that is smaller than the energy used by conventional methods without increasing a non-selected voltage from ±5V by using a high-frequency pulse. If an all-selected voltage is the same, writing time may be reduced by reducing time to apply a voltage. However, increasing the frequency raises power consumption; thus, it is desirable to increase a pulse frequency by suppressing increase in power consumption within an allowable range.

For example, in FIG. 19A, the all-selected voltage is ±20 V; the half-selected voltage is ±10V, and the non-selected voltage is ±5 V, and a low-frequency pulse is applied for a period of 2 ms. Therefore, $V^2T$ is 800 $V^2$ ms indicated by U when the all-selected voltage is applied, 200 $V^2$ ms indicated by R when the half-selected voltage is applied, and 50 $V^2$ ms when non-selected voltage is applied. For example, in FIG. 19B, the all-selected voltage is ±22 V; the half-selected voltage is ±12V, and the non-selected voltage is ±5 V, and a low-frequency pulse is applied for a period of 1.5 ms. Therefore, $V^2T$ is 726 $V^2$ ms indicated by U' when the all-selected voltage is applied, 216 $V^2$ ms indicated by R' when the half-selected voltage is applied, 50 $V^2$ ms when the non-selected voltage is applied. Accordingly, with approximately the same amount of energy, time to apply voltage may be reduced.

By now, it has been described that the structure of the cholesteric liquid crystal panel and the driving frequencies for an embodiment in which a ratio $V^2T$ of the all-selected voltage to the half-selected voltage is in a range between 2 to 4. Hereunder, a display apparatus that uses such cholesteric liquid crystal panel will be described.

For describing a display apparatus according to the embodiment, the entire contents of the Japanese Laid-open Patent Publication No. 2009-163092 and WO2007070093 are incorporated herein by reference.

Figure 20:
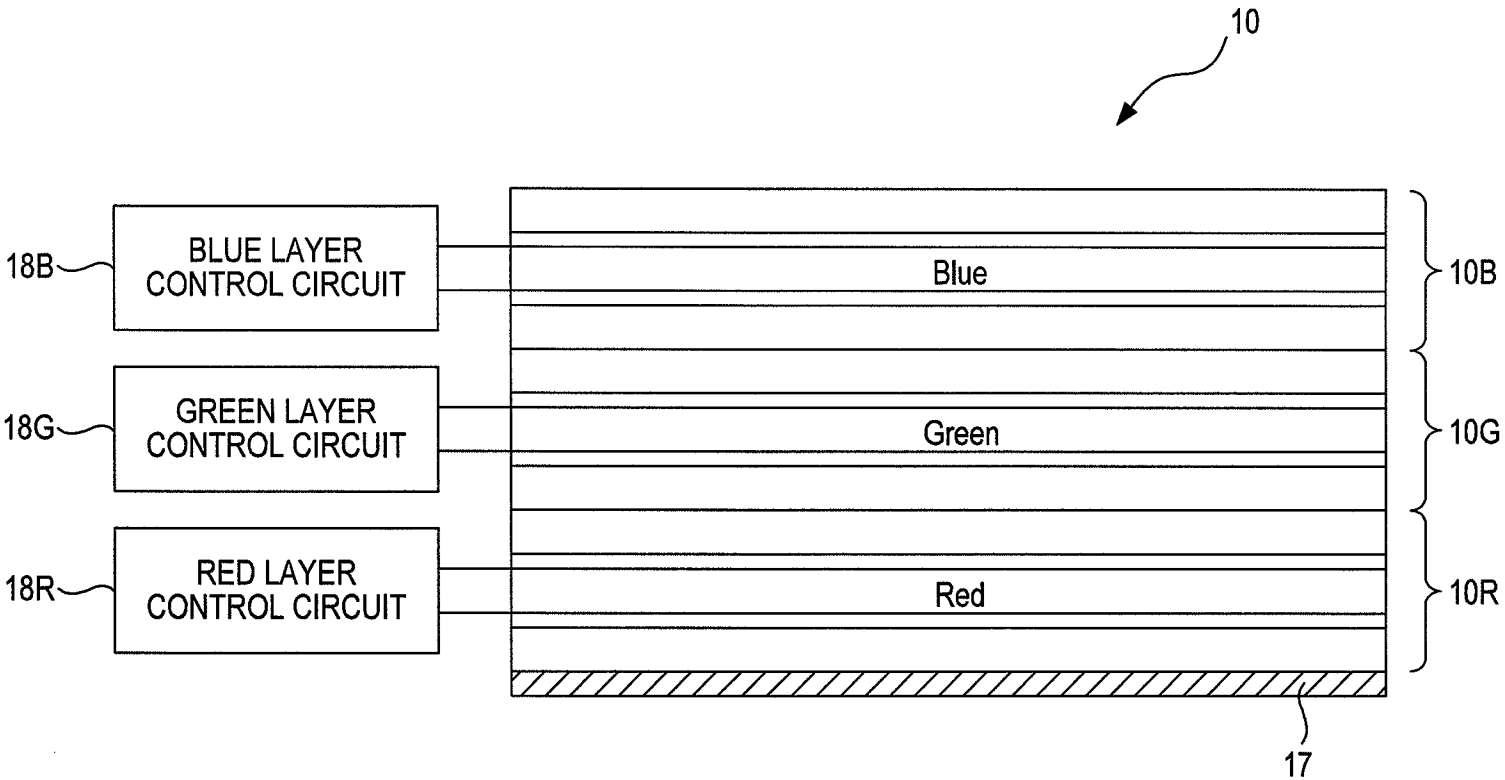
FIG. 20 illustrates an exemplary laminate structure of cholesteric liquid crystal element of a color display apparatus.

FIG. 20 illustrates an exemplary structure of a display device 10 that may be used in the embodiment. As illustrated in FIG. 20, in the display device 10, three panels of a blue panel 10B, a green panel 10G, and a red panel 10R are laminated from the viewing side, and a light absorbing layer 17 is provided under the red panel 10R. Although the panels 10B, 10G, and 10R have the same structure as the panel described in FIG. 14, for example, the wavelength characteristics differ. Liquid crystal materials and chiral materials are selected and the contents of the chiral materials are determined so that the center wavelength of reflection of the blue panel 10B is blue (approximately 480 nm), the center wavelength of reflection of the green panel 10G is green (approximately 550 nm), and the center wavelength of reflection of the red panel 10R is red (approximately 630 nm). The panels 10B, 10G, and 10R are driven by a blue layer control circuit 18B, a green layer control circuit 18G, and a red layer control circuit 18R, respectively.

Figure 21:
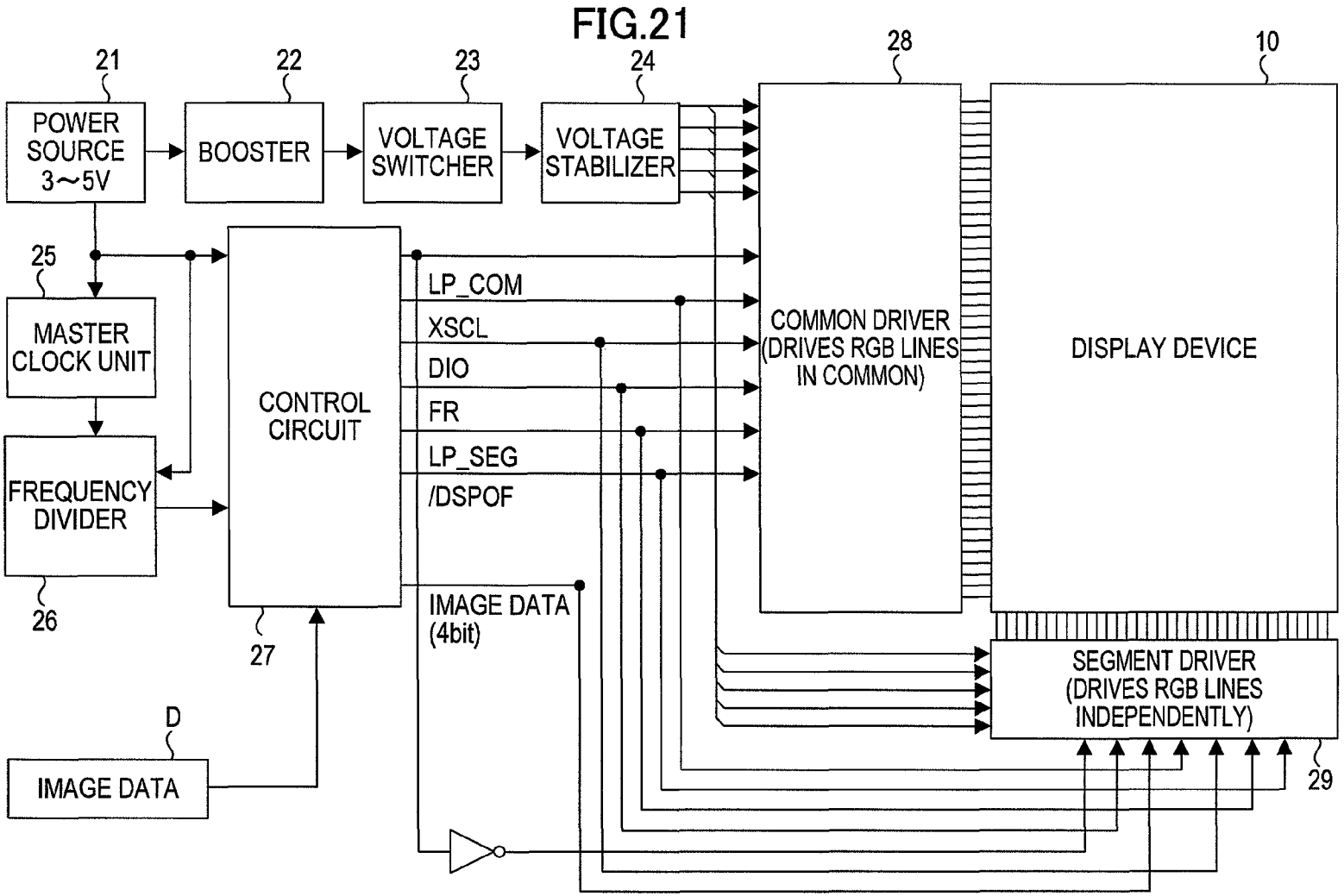
FIG. 21 illustrates a general structure of an exemplary embodiment of a display apparatus.

FIG. 21 illustrates a general structure of the display apparatus which may be used in an exemplary embodiment. The display device 10 is of A4 size and XGA format, and has 1024×768 pixels. A power source 21 outputs a voltage of, for example, 3 V to 5 V. A booster 22 raises the input voltage from the power source 21 to 36 V to 40 V by a regulator such as a DC-DC converter. As the booster regulator, a dedicated IC is widely used, and the IC has the function of adjusting the boosted voltage by setting a feedback voltage. Therefore, the boosted voltage can be changed by selecting a plurality of voltages generated by voltage division by resistance or the like and supplying them to a feedback terminal.

A voltage switcher 23 generates various voltages by resistance division or the like. While a high-voltage analog switch may be used for the switching between a reset voltage and a tone writing voltage by the voltage switcher 23, a simple switching circuit by a transistor may be used. As a voltage stabilizer 24, a voltage follower circuit of an operational amplifier is desirably used in order to stabilize various voltages supplied from the voltage switcher 23. As the operational amplifier, one that is resistant to the capacitive load is desirably used. A structure of switching the amplification factor by switching the resistance coupled to the operational amplifier is widely known, and by using this structure, the voltage output from the voltage stabilizer 24 may be easily switched.

A master clock unit 25 generates a basic clock on which operations are based. A frequency divider 26 divides the basic clock to generate various clocks necessary for operations described later.

A control circuit 27 generates a control signal based on the basic clock, various clocks, and image data D, and supplies it to a common driver 28 and a segment driver 29.

The common driver 28 drives 768 scan lines, and the segment driver 29 drives 1024 data lines. Since the image data supplied to each of the RGB pixels is different, the segment driver 29 independently drives the data lines. The common driver 28 drives RGB lines in common. In the present embodiment, a general-purpose binary-output STN driver is used as the driver IC. As the driver IC, various available driver ICs may be used.

The image data input to the segment driver 29 is 4-bit data D0-D3 where a full-color original image is converted into 4096-color data of 16 tones for each of R, G, and B by the error diffusion method. For this tone conversion, a method by which a high display quality is obtained is desirable, and the blue-noise mask method may be used as well as the error diffusion method. Moreover, image quality improving processing such as contrast enhancement processing may be performed before and after the tone conversion.

Next, an image writing operation of a display apparatus in the present embodiment will be described.

Figure 22:
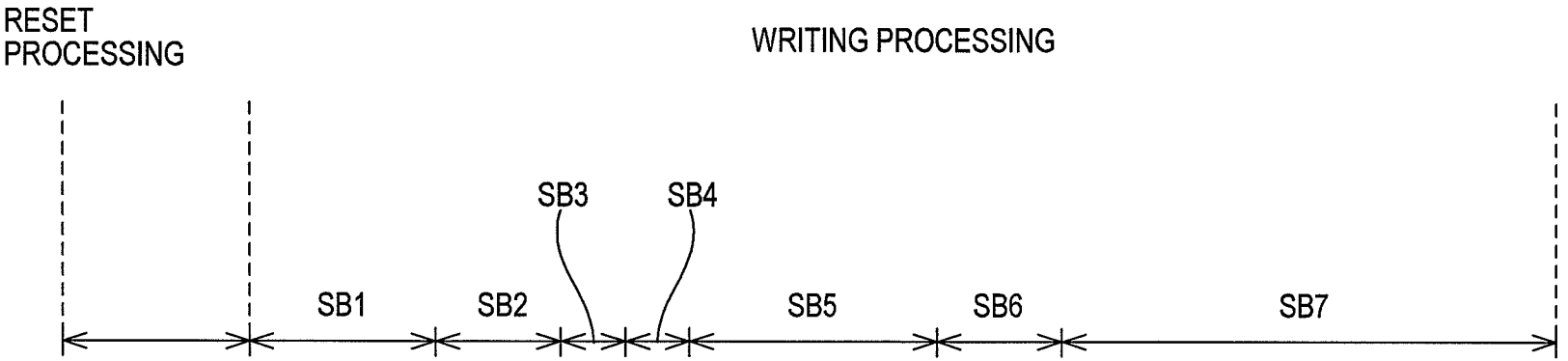
FIG. 22 illustrates a schematic diagram for explaining a reset processing and a writing operation of an exemplary embodiment.

FIG. 22 illustrates an image writing operation. The image writing operation includes a reset processing that resets all pixels to a planar state, and a writing processing that selectively applies tone pulses after the reset processing to obtain a state of intermediate tone in which a planar state and a focal-conic state coexist. The reset processing is also called an initialization step. The writing processing is also called a tone step. The writing processing involves seven sub-frames SB1 to SB7. Scan operation is applied for respective sub-frames and tone pulses are selectively applied to all pixels in the whole area. Tone pulses that are applied to the seven sub-frames SB1 to SB7 have different widths.

FIG. 23A illustrates exemplary output voltages of ON and OFF of a common driver 28 and a segment driver 29 in the reset processing. FIG. 23B depicts voltages applied to pixels at the reset processing. At the reset processing, voltages are applied to all pixels at the same time; thus, the reset processing completes within a short period. Hence, an inclination of the area Q of response characteristics is not related to the reset processing time.

Figure 24A:
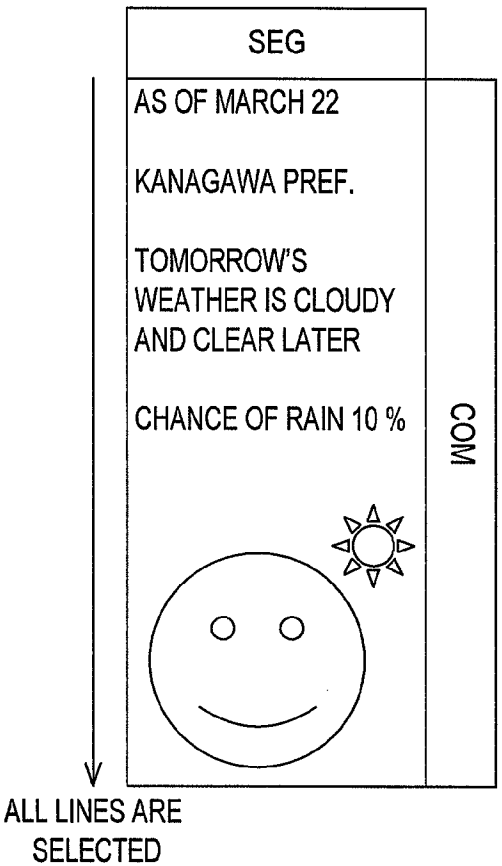
FIGS. 24A to 24C illustrate exemplary views for explaining a planar reset processing for a whole area at the reset processing of an embodiment.
Figure 24B:
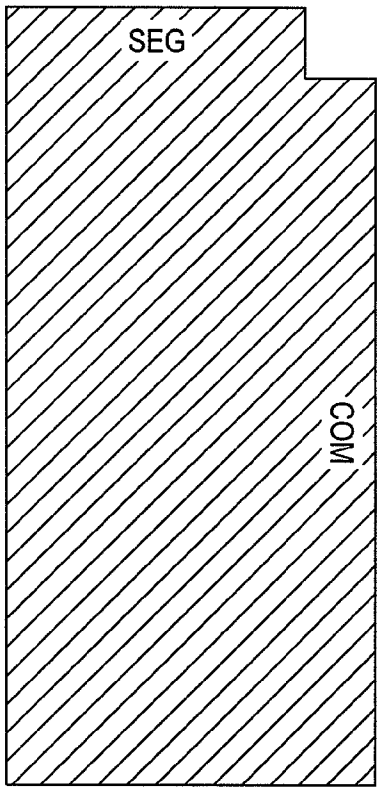
Figure 24C:
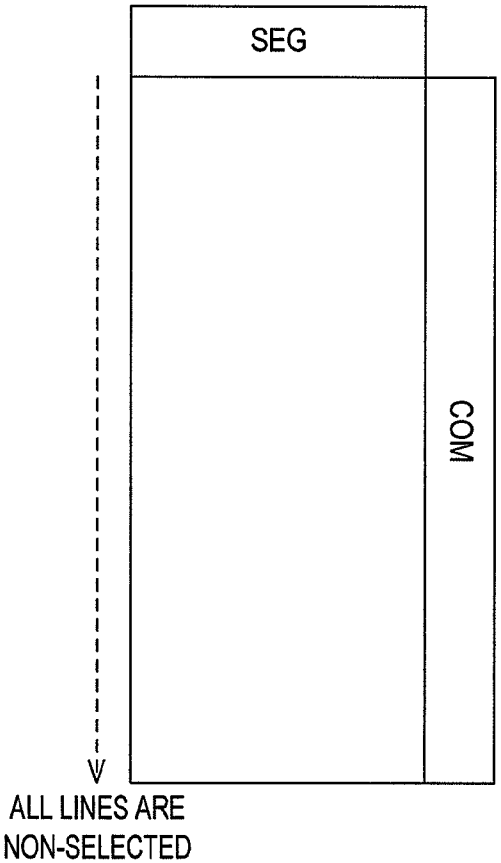

FIG. 24A to 24C illustrate an outline of a reset processing as an example.

Assuming that there is a display to which a writing is applied as illustrated in FIG. 24A, after the output voltages of the segment driver 29 are all set at the ground (GND) level, all the output lines of the common driver 28 are brought into a selected state. To set all the output voltages at the GND level, it is preferable to assert a voltage off function (/DSPOF) of an STN driver etc.

Negating the /DSPOF applies +36 V to all of the selected lines, and turns all pixels to a homeotropic state as illustrated in FIG. 24B.

Voltages that are applied to all lines are reversed from +36 V to −36 V. To reverse the voltages, a polar signal of a general-purpose driver may be reversed. Several different voltage settings for the common driver 28 and the segment driver 29 may exist for this processing. However, voltage settings illustrated in FIG. 23A is preferable, because the settings allow to apply ±36V to all pixels regardless of output values from the segment driver 29.

While the appropriate application times of +36 V and −36 V may differ according to the structure of the display device, in the present embodiment, the signals are pulses with a pulse width of several tens of ms.

Switching the voltage from −36 V to 0 V changes the state of all the pixels from the homeotropic state to the planar state; thereby, white state is obtained as illustrated in FIG. 24C. For switching from −36V to 0 V, it is preferable to use/DSPOF provided by the above described general purpose driver. When /DSPOF is used, discharge is forcibly caused at the short circuit of the driver IC, thus the discharge time of charging and discharging of the display device may be shortened. Since the transition to the planar state requires steepness of voltage pulses, with this forcible discharge using /DSPOF, the pixels may be reset to the planar state with reliability even in the case of large-size display devices.

FIG. 25A illustrates exemplary output voltages of ON and OFF of the common driver 28 and the segment driver 29 in the writing processing. FIG. 25B illustrates exemplary voltages applied to pixels by the output voltage. As depicted in the figures, the all-selected voltage is ±24 V, the half-selected voltage is ±14 V, and the non-selected voltage is ±5 V. For each of sub-frames SB1 to SB7, a pulse voltage with a different pulse width is applied. Setting different voltages for each of sub-frames SB1 to SB7 is possible. For example, using above described $V^2T$ near the interface of the area P and the area Q such as very bright tone (extremely highlighted) may lower repeatability of the tone. Hence, $V^2T$ setting that prioritizes tone repeatability may be used for special tones such as extremely highlighted near the both edges of the area Q.

Figure 26:
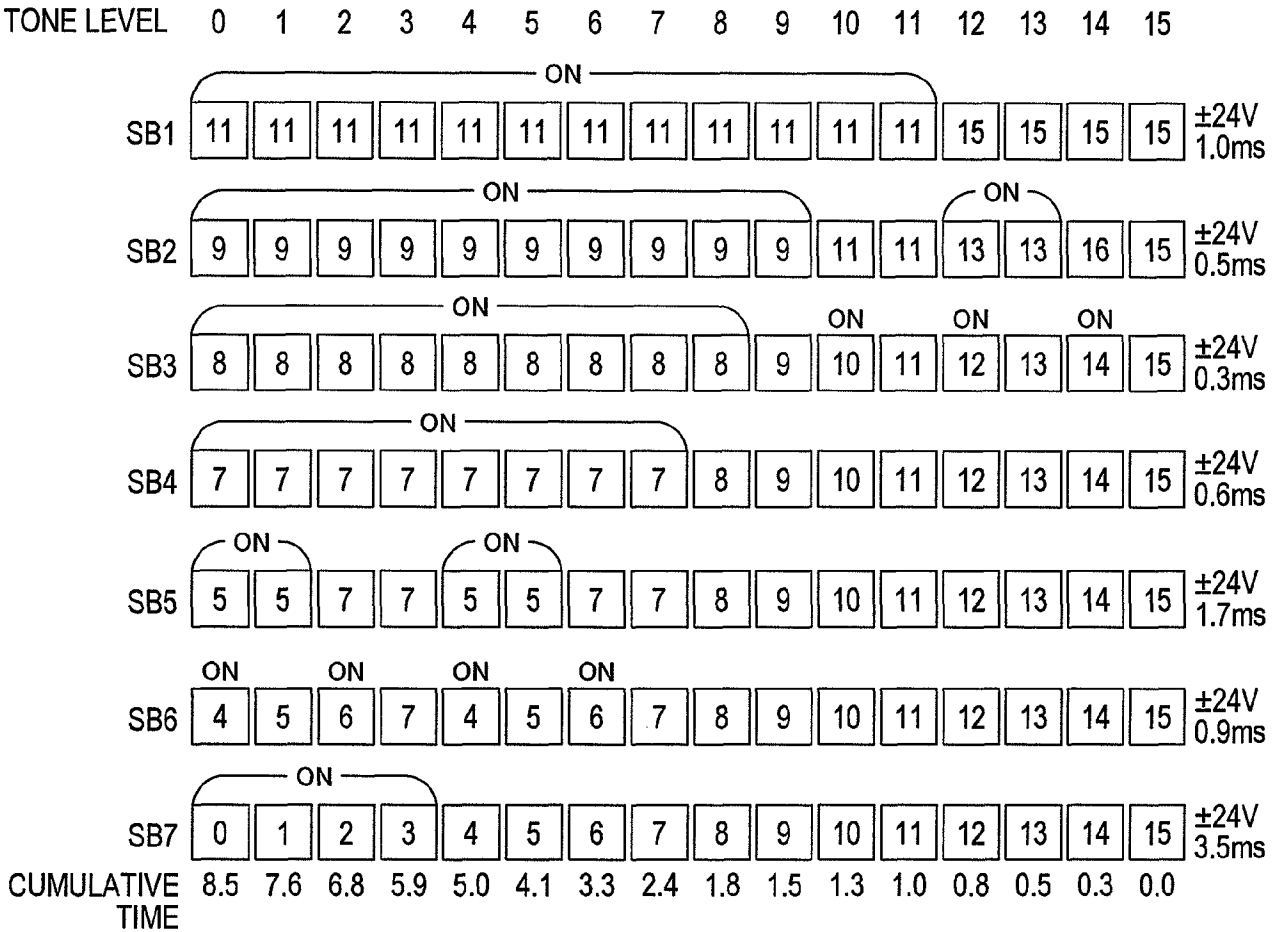
FIG. 26 illustrates pulse widths for sub-frames SB1 to SB7 and sub-frames selected for tone levels of an exemplary embodiment.

FIG. 26 illustrates examples of pulse widths for sub-frames SB1 to SB7 and sub-frames selected for tone levels. The all-selected voltage, the half-selected voltage, and the non-selected voltage are the same for all of sub-frames SB1 to SB7 and ±24 V, ±14 V, and ±5 V respectively. The width of pulses applied to sub-frames SB1 to SB7 are 1.0 ms, 0.5 ms, 0.3 ms, 0.6 ms, 1.7 ms, 0.9 ms, and 3.5 ms respectively. The tone level includes 16 levels from 0 to 15. Sub-frames to be ON are selected depending on a tone level, and accordingly pulses are applied for a time indicated by a cumulative time depending on a tone level. For example, pixels for a tone level 6 are ON at SB1 to SB4, and SB6, and the cumulative time is 3.3 ms.

A scan driver 28 applies a scan pulse with a set pulse width to each sub-frame by sequentially changing a line (electrode) position. A segment driver 29 applies, in synchronization with the application of the scan pulse, all-selected voltages to electrodes for pixels to which writing are applied and half-selected voltages to electrodes for pixels to which writing are not applied. Non-selected voltages are applied to pixels in lines other than those to which scan pulses are applied.

As illustrated in FIG. 26, as writing processing proceeds with sub-frames, a rate of low tones increases, and the writing is nearing completion.

Here, voltages applied to all sub-frames are assumed to be the same; however, response characteristics differ depending on pulse widths. Thus, settings of all-selected voltage, half-selected voltage, and non-selected voltage may be switched for respective sub-frames to perform writing in a shorter time.

The pulse width, all-selected voltage, half-selected voltage, and non-selected voltage for reducing the writing time may be set for a part of sub-frames, and as for other sub-frames, the settings may be performed by putting emphasis on a uniform tone. For example, when a highly uniform tone is emphasized, regardless of the above described settings of the allowable range of uneven tone, shadow (dark tone) is written so that uneven tone is relatively inconspicuous. In other words, for a sub-frame with a large pulse width, settings that take account of the above condition of $V^2T$ and short time writing are set, and for other sub-frames, settings for tone settings with high accuracy are applied even if the writing time becomes long. When putting emphasis on a writing time, settings that take account of short writing time are applied for all sub-frames.

All examples and conditional language provided herein are intended for pedagogical purposes to aid the reader in understanding the principles of the invention and the concepts contributed by the inventor to furthering the art, and are to be construed as being without limitation to such specifically provided examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

The invention claimed is:

1. A display apparatus, comprising:

a display device that employs cholesteric liquid crystal;

a driver circuit that passively drives a plurality of pixels in the display device; and a control circuit that controls the driver circuit, wherein the control circuit applies (1) an initialization pulse to reset a plurality of pixels to a planar state, (2) a tone pulse to obtain a state of intermediate tone in which the planar state and a focal-conic state coexist and display the tone, and wherein the tone pulse includes (a) an all-selected voltage pulse to be applied to a plurality of pixels the tone state of which are changed, and (b) a half-selected voltage pulse and a non-selected voltage pulse to be applied to a plurality of pixels the tone state of which are not changed, and wherein a ratio of a voltage of the all-selected voltage pulse to a voltage of the half-selected voltage pulse is larger than $2^{1/2}$ and smaller than 2.

2. The display apparatus according to claim 1, wherein the plurality of pixels to be rewritten include a plurality of sub-frames when displaying the tone, and a tone state is determined depending on a cumulative time of the all-selected voltage pulse that is applied to the plurality of sub-frames.

3. The display apparatus according to claim 1, wherein the display device includes a layer of the cholesteric liquid crystal and an alignment layer that is in contact with the cholesteric liquid crystal layer, and satisfies at least two of the following three conditions:

a first condition is that the alignment layer has a pretilt angle of 0.5° to 8°, a second condition is a thickness of the cholesteric liquid crystal layer is 4 μm to 6 μm, and a third condition is that dielectric anisotropy of the cholesteric liquid crystal is within a range of 15 to 25.

4. The display apparatus according to claim 1, wherein the driver circuit includes a general-purpose STN driver that simultaneously outputs two values of voltages.

* * * * *

UNITED STATES PATENT AND TRADEMARK OFFICE

CERTIFICATE OF CORRECTION

PATENT NO. : 8,487,966 B2
APPLICATION NO. : 12/626142
DATED : July 16, 2013
INVENTOR(S) : Masaki Nose It is certified that error appears in the above-identified patent and that said Letters Patent is hereby corrected as shown below:

On the Title Page, Item (54), and in the Specification, Column 1, Line 1 the title should read as: --DESIGN SUPPORT METHOD--

Signed and Sealed this
Twentieth Day of August, 2013

Teresa Stanek Rea
*Acting Director of the United States Patent and Trademark Office*